US012270593B2

(12) United States Patent
Park et al.

(10) Patent No.: US 12,270,593 B2
(45) Date of Patent: Apr. 8, 2025

(54) REFRIGERATOR

(71) Applicant: LG ELECTRONICS INC, Seoul (KR)

(72) Inventors: Kyong Bae Park, Seoul (KR); Sangbok Choi, Seoul (KR); Sungwook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 252 days.

(21) Appl. No.: 18/019,730

(22) PCT Filed: Jul. 19, 2021

(86) PCT No.: PCT/KR2021/009255

§ 371 (c)(1),
(2) Date: Feb. 3, 2023

(87) PCT Pub. No.: WO2022/030808

PCT Pub. Date: Feb. 10, 2022

(65) Prior Publication Data

US 2024/0011697 A1 Jan. 11, 2024

(30) Foreign Application Priority Data

Aug. 6, 2020 (KR) ..... 10-2020-0098364

(51) Int. Cl.

| | |
|---|---|
| ***F25D 21/02*** | (2006.01) |
| ***F25D 17/06*** | (2006.01) |
| ***F25D 21/00*** | (2006.01) |

(52) U.S. Cl.
CPC ..... *F25D 21/02* (2013.01); *F25D 17/062* (2013.01); *F25D 21/002* (2013.01)

(58) Field of Classification Search
CPC ..... F25D 21/002; F25D 21/02; F25D 21/06; F25D 21/08; F25D 21/025; F25D 17/062; F25D 17/067; F25D 17/08; F25B 41/20
See application file for complete search history.

(56) References Cited

U.S. PATENT DOCUMENTS

| | | | | |
|---|---|---|---|---|
| 4,101,747 | A * | 7/1978 | Houk | F25D 21/025 200/81 R |
| 2017/0241696 | A1* | 8/2017 | Ma | F25D 21/12 |
| 2017/0248360 | A1* | 8/2017 | Tao | F25D 21/12 |
| 2019/0072310 | A1* | 3/2019 | Choi | F25D 21/006 |
| 2019/0277554 | A1* | 9/2019 | Park | F25D 21/00 |
| 2020/0224951 | A1* | 7/2020 | Seong | F25D 23/04 |

FOREIGN PATENT DOCUMENTS

| | | | |
|---|---|---|---|
| KR | 10-2016-0027761 | A | 3/2016 |
| WO | 2019190113 | A1 | 10/2019 |

* cited by examiner

*Primary Examiner* — Nelson J Nieves
(74) *Attorney, Agent, or Firm* — Bryan Cave Leighton Paisner LLP

(57) ABSTRACT

A refrigerator includes a first heater, a second heater, and a third heater, and the third heater is located inside a frost detection flow path and generates heat. Accordingly, during a defrosting operation, the inside of the frost detection flow path may be prevented from being blocked. Or freezing of the frost check sensor provided in the frost detection flow path may be prevented.

20 Claims, 19 Drawing Sheets

【Figure 1】
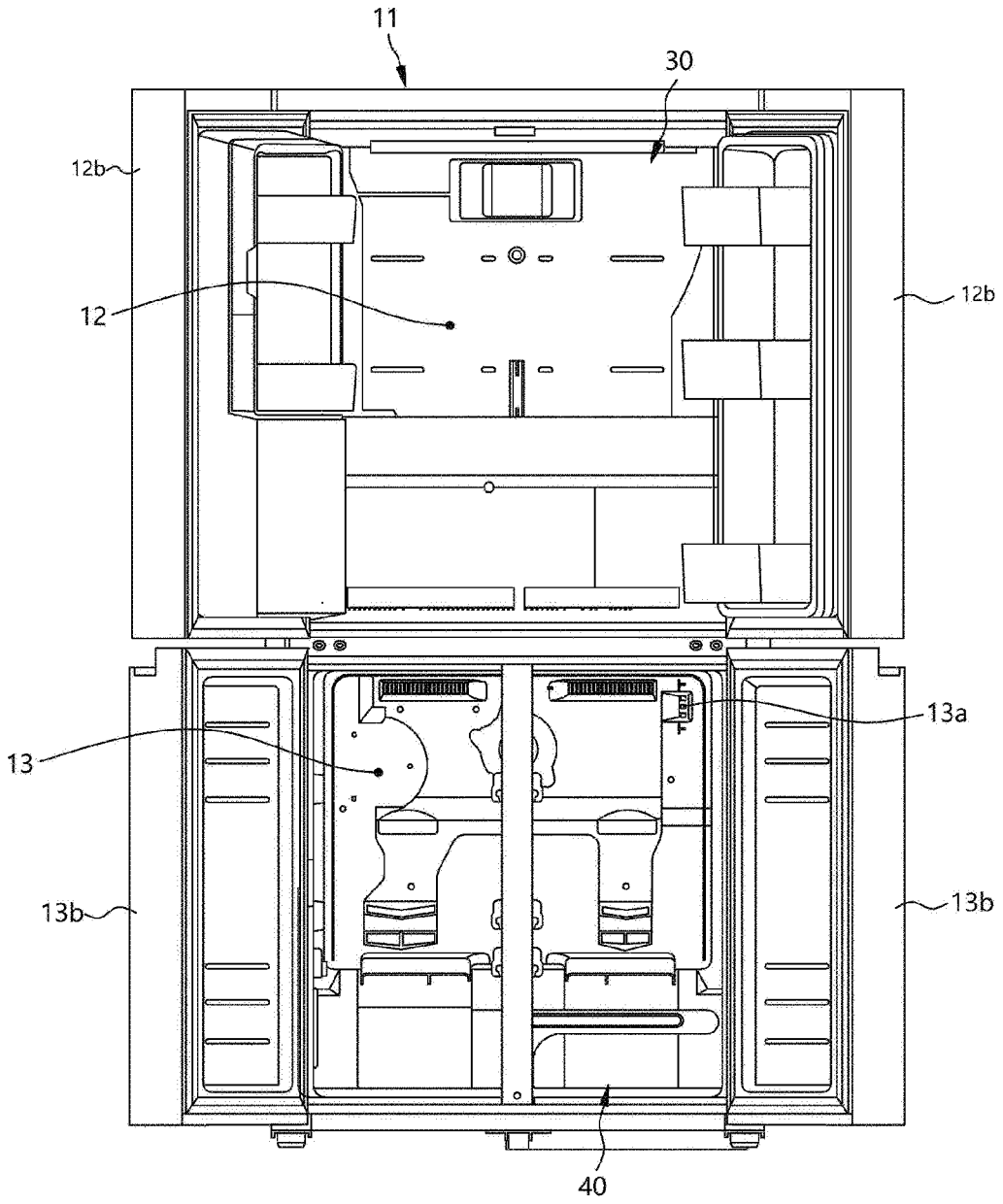

【Figure 2】
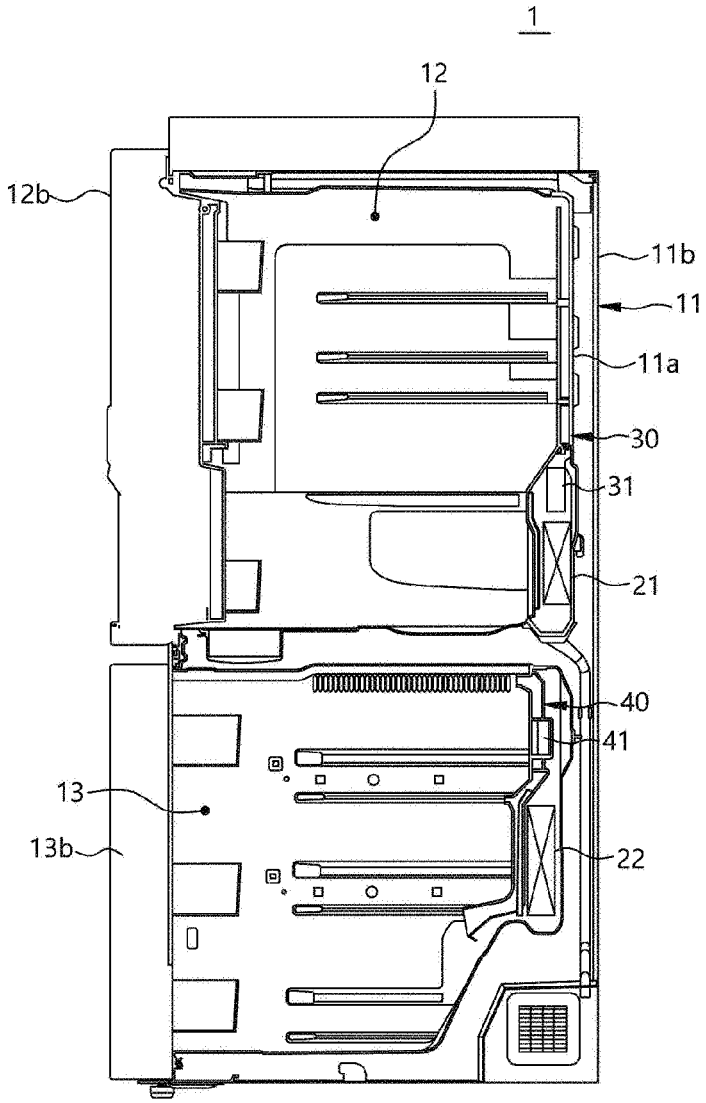

【Figure 3】
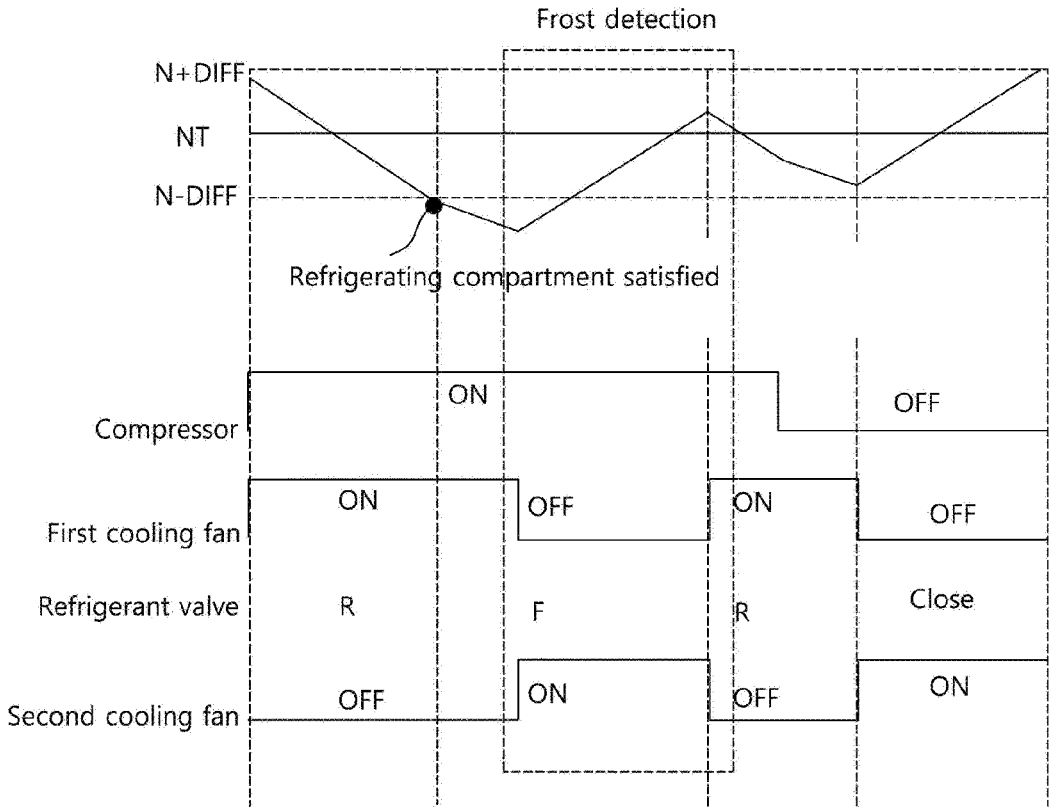
【Figure 4】
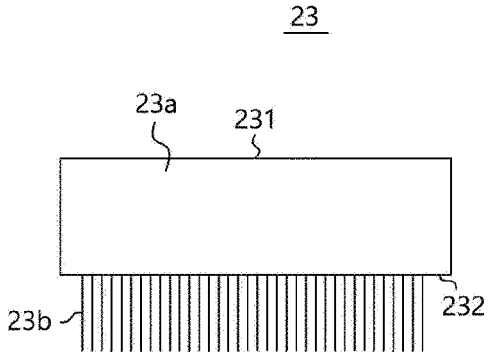

【Figure 5】
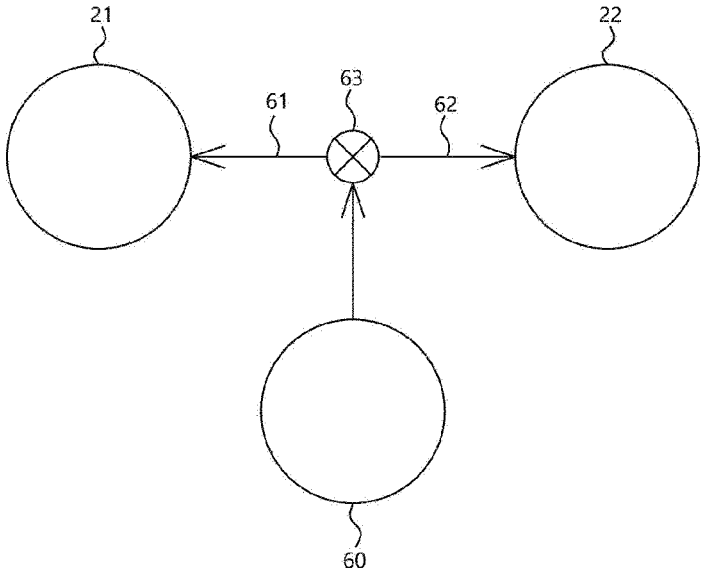

【Figure 6】
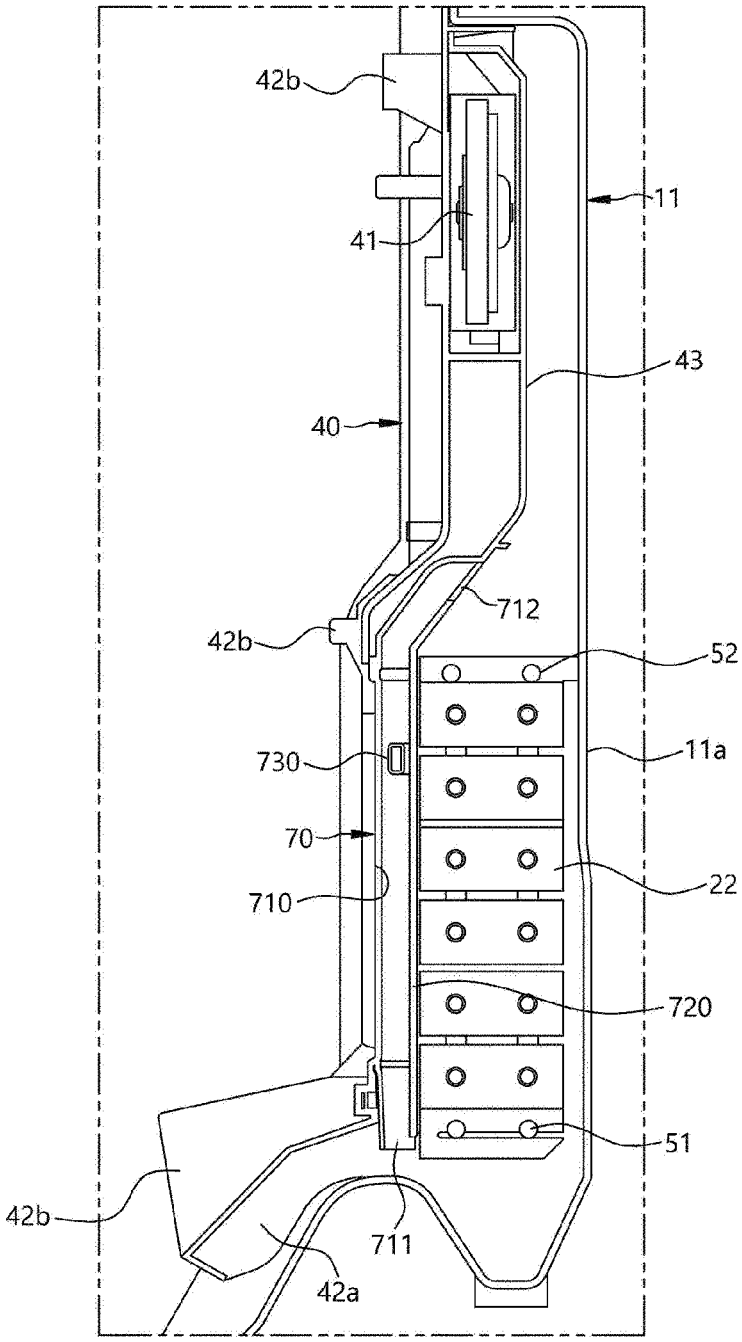

【Figure 7】
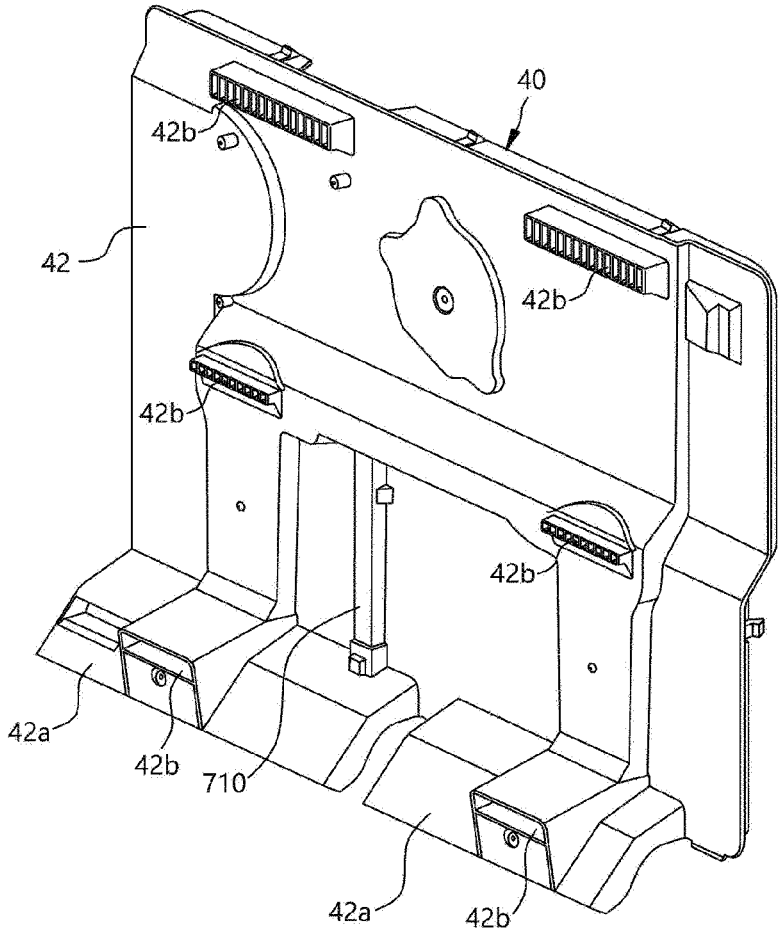

【Figure 8】
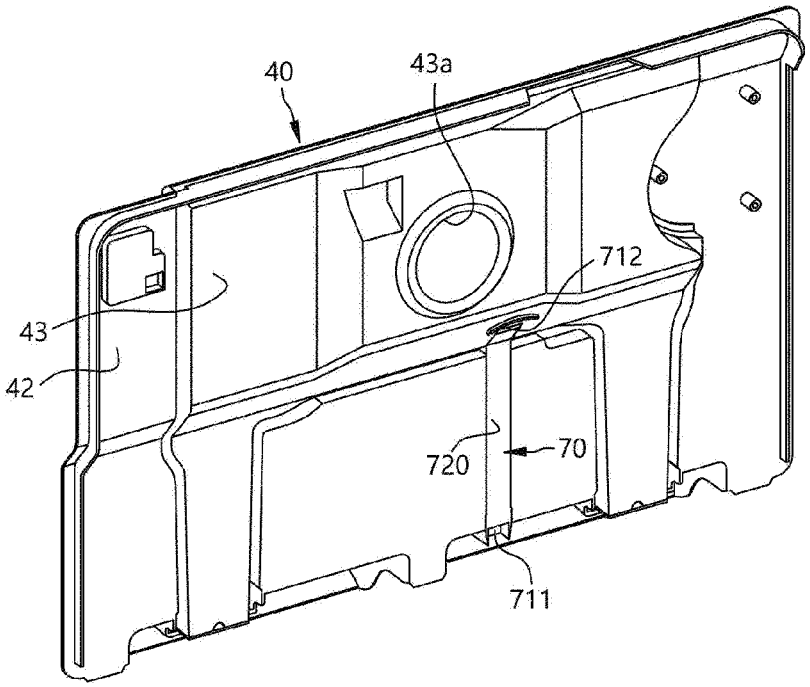

【Figure 9】
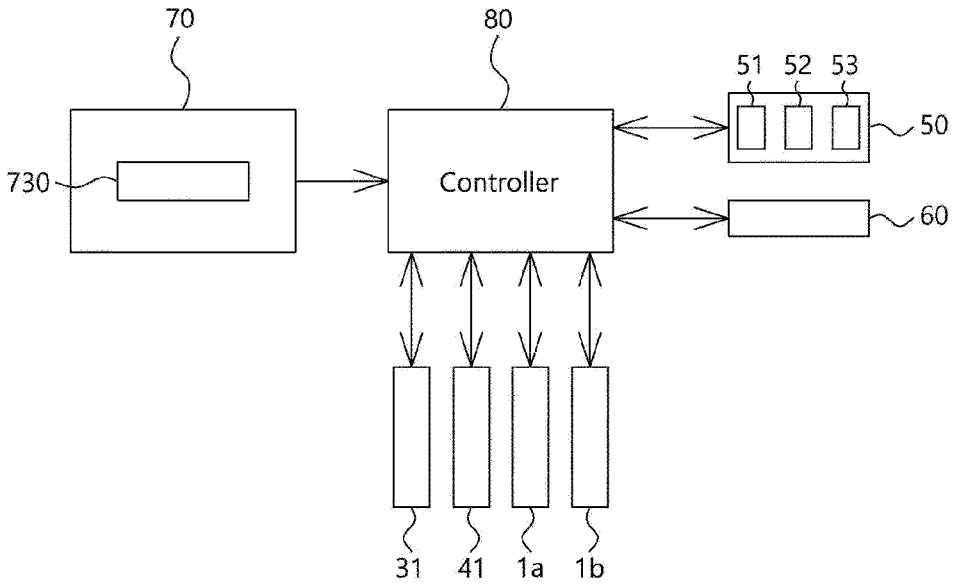
【Figure 10】
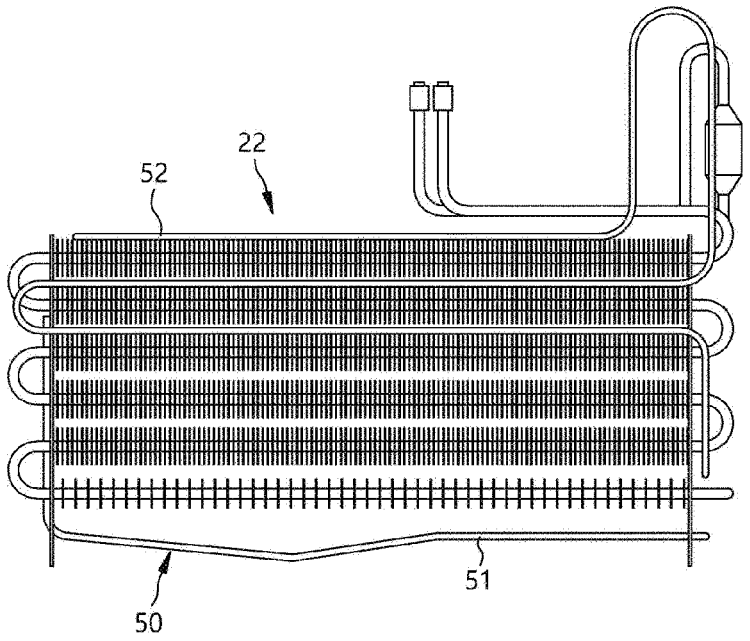

【Figure 11】
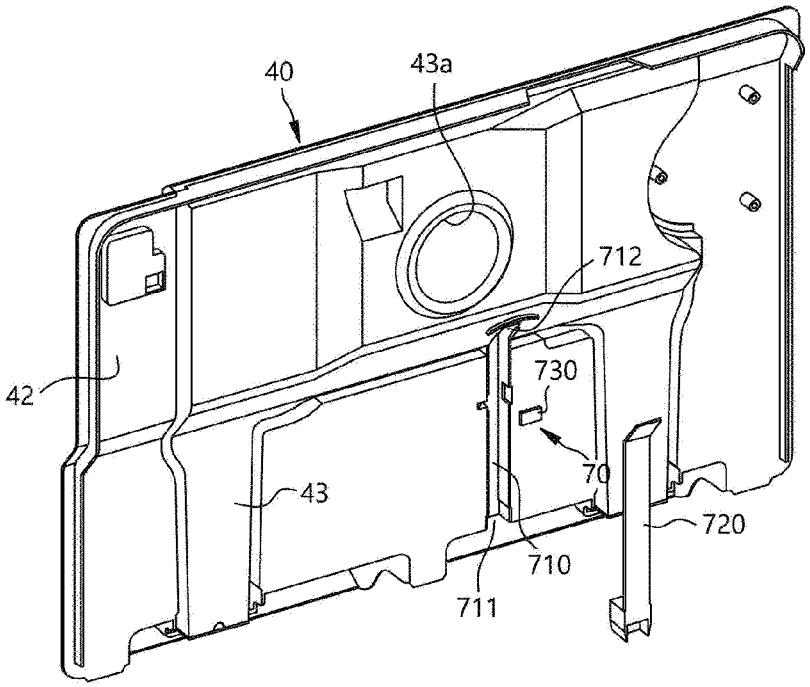

【Figure 12】
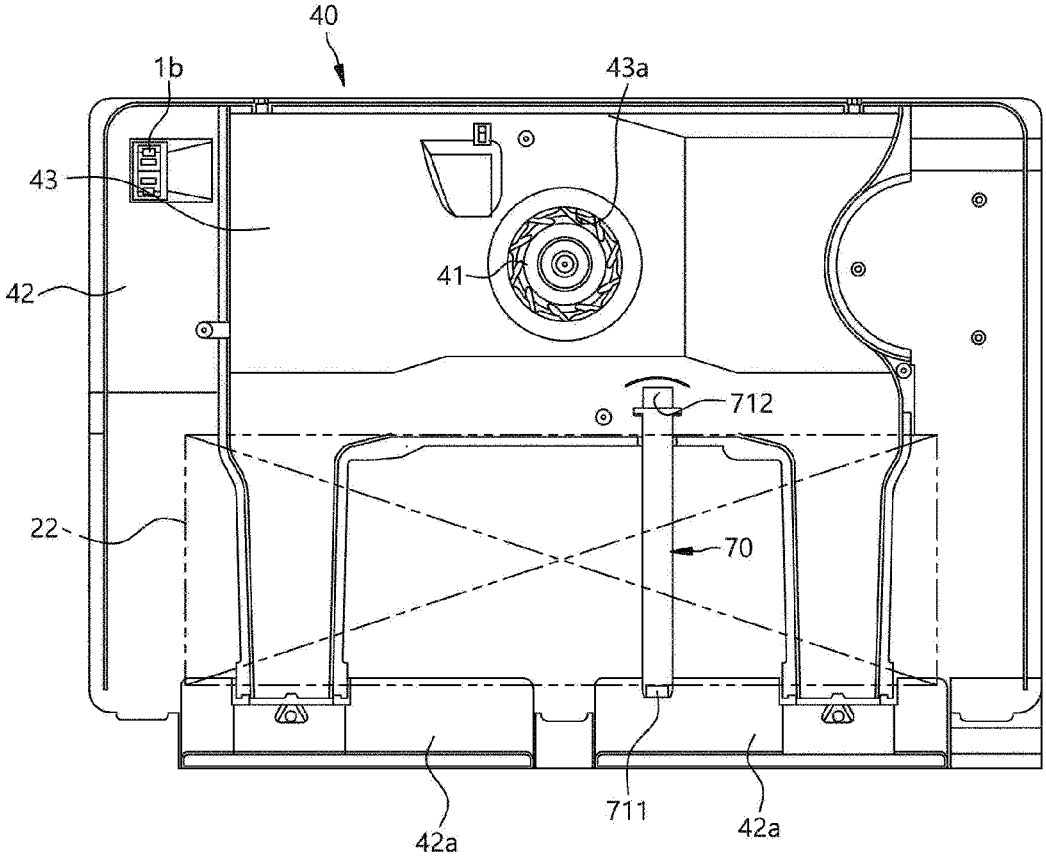

【Figure 13】
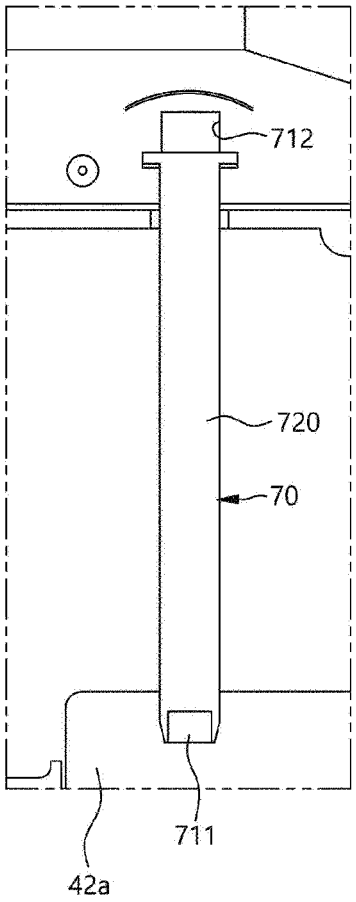

【Figure 14】
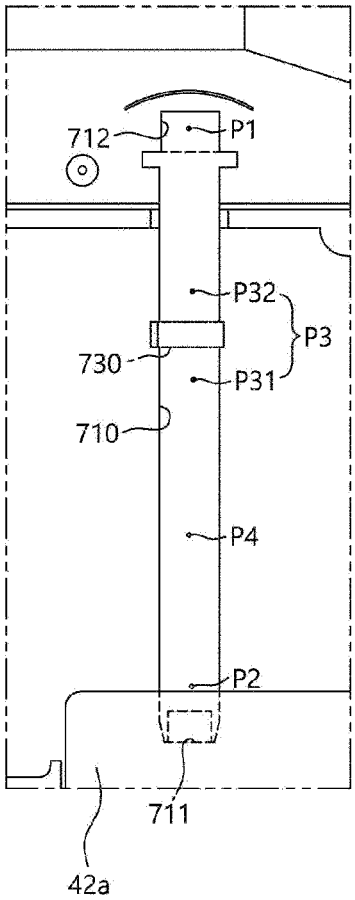

【Figure 15】
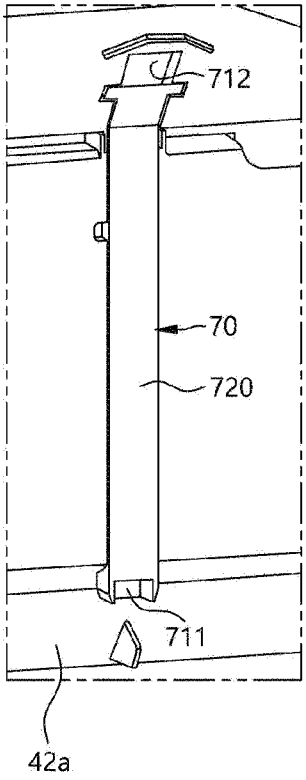

【Figure 16】
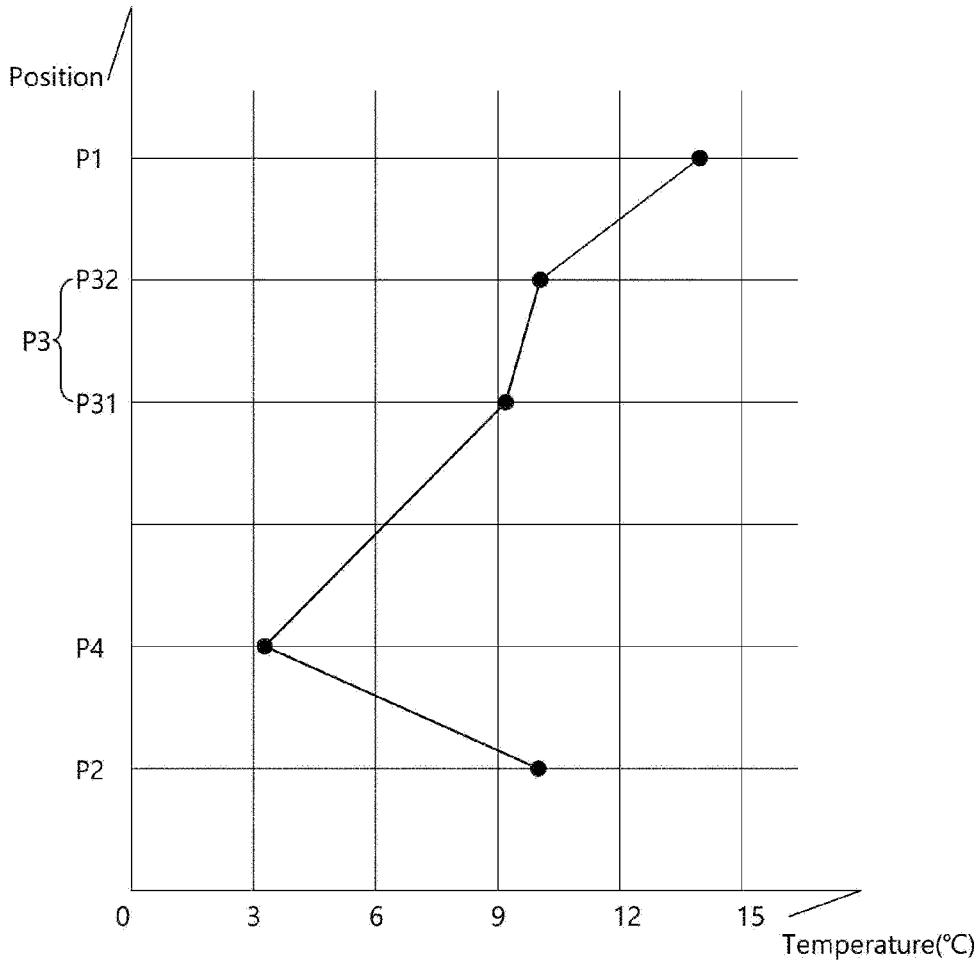

【Figure 17】
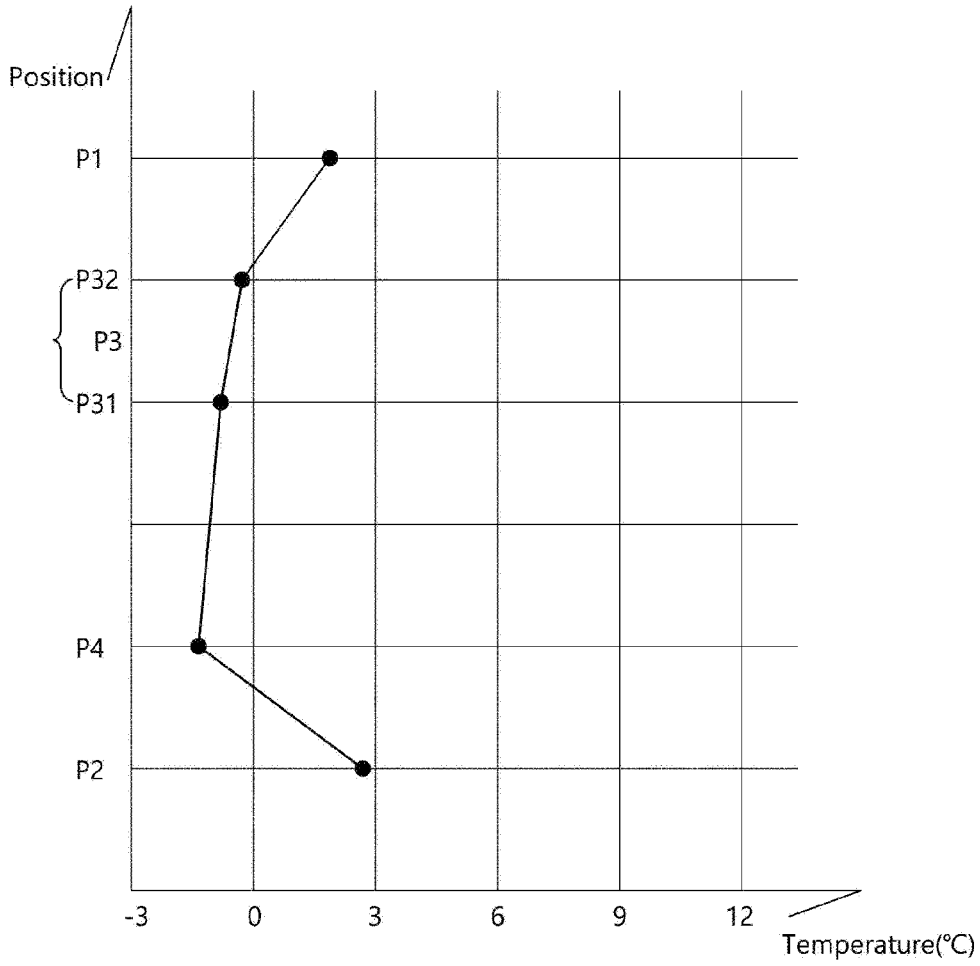

【Figure 18】
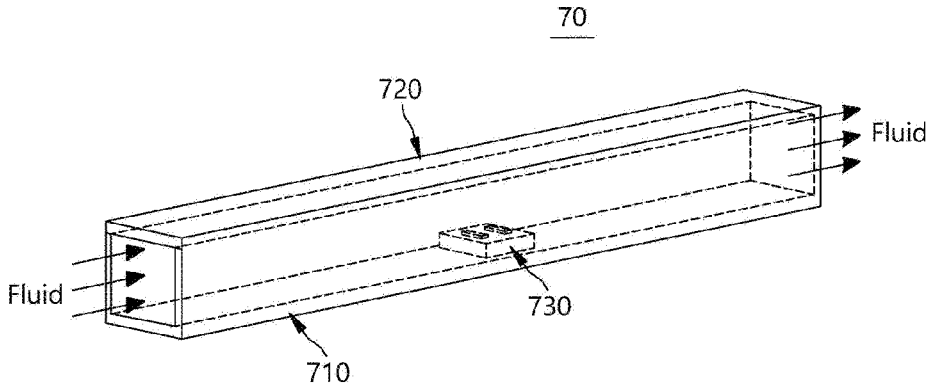
【Figure 19】
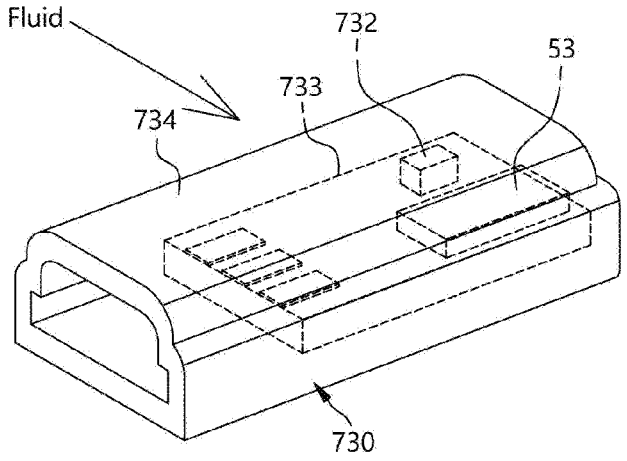

【Figure 20】
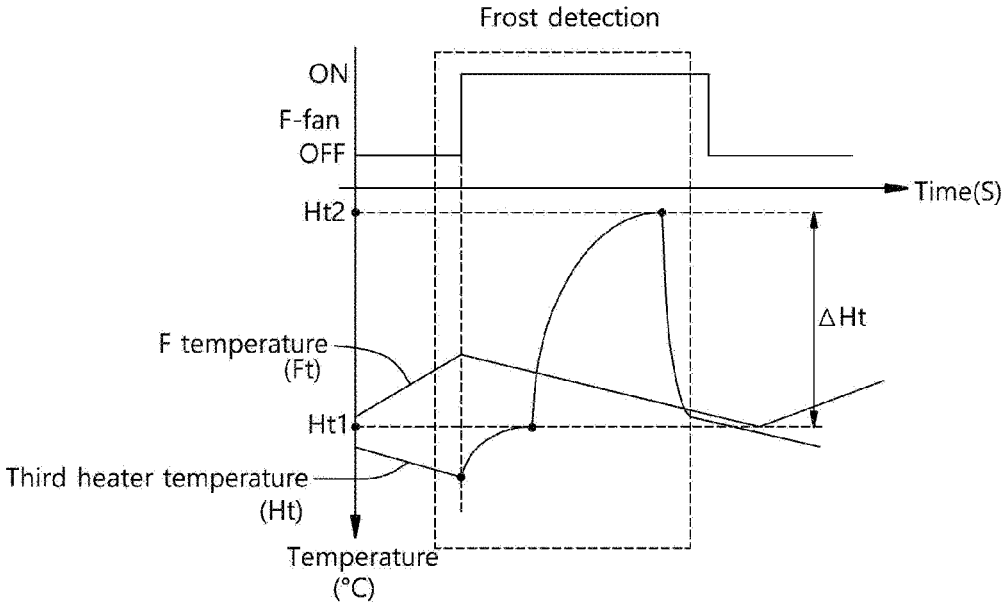

【Figure 21】
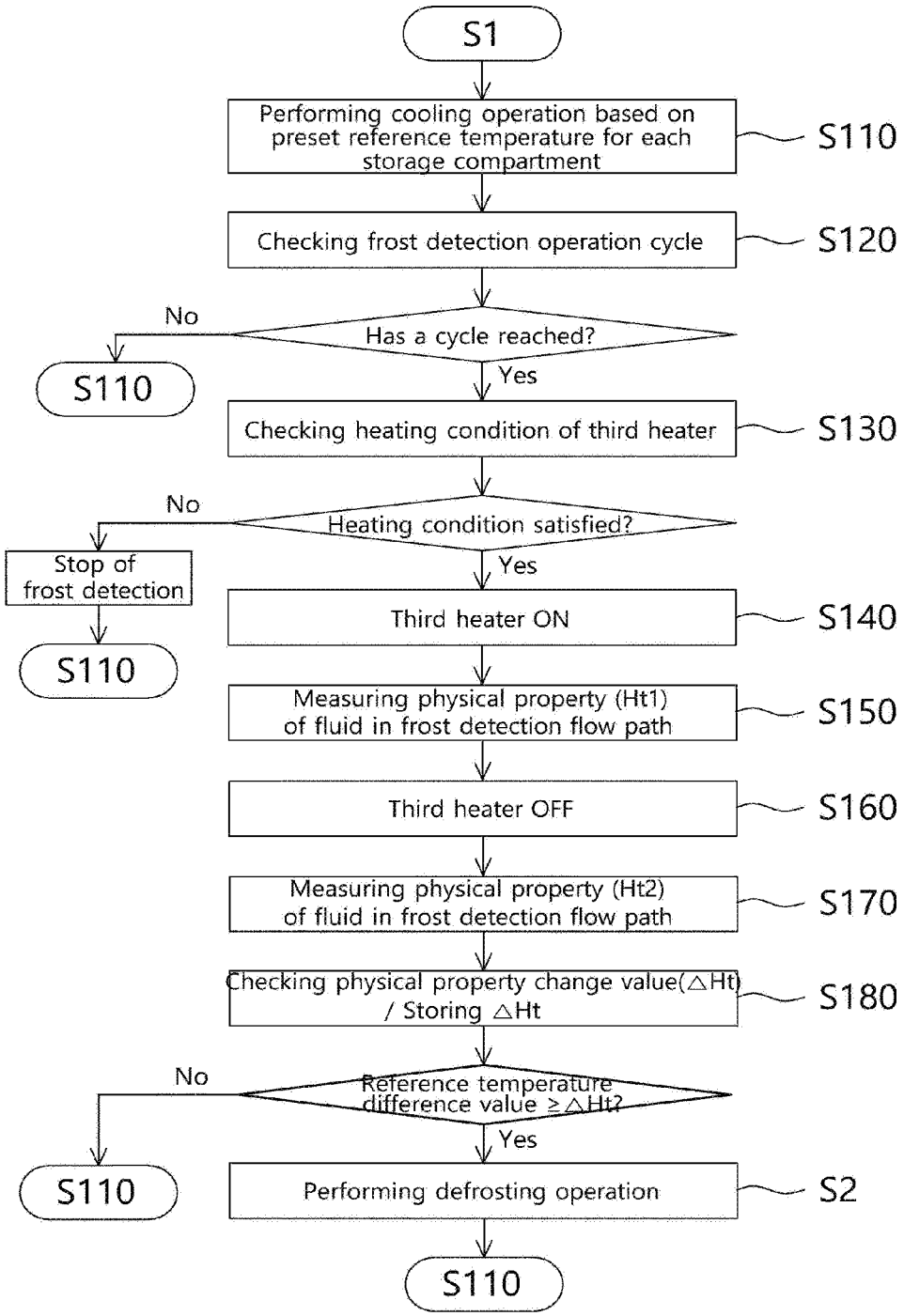

【Figure 22】
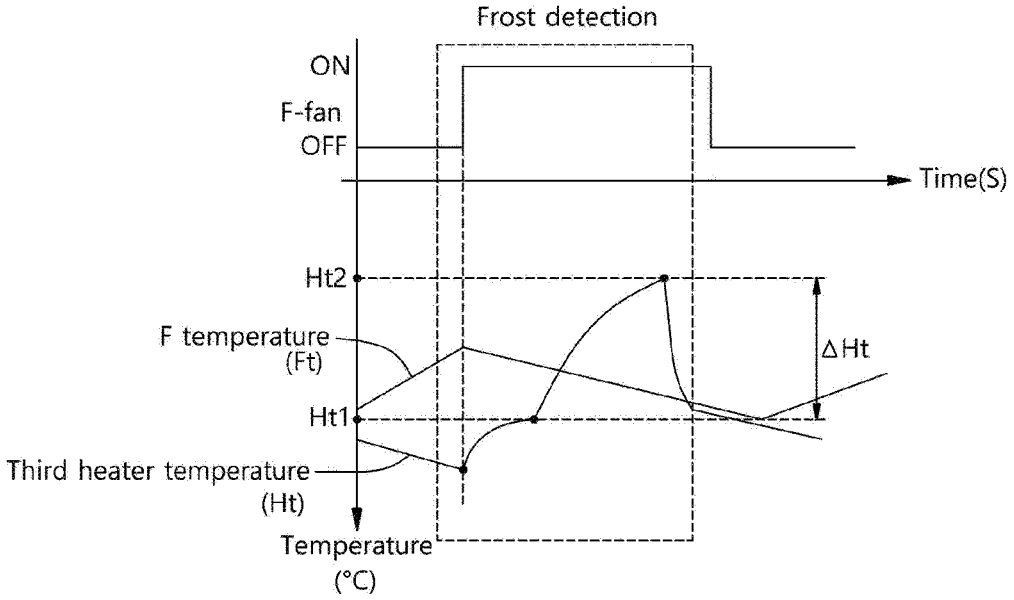

REFRIGERATOR

This application is the National Stage filing under 35 U.S.C. 371 of International Application No. PCT/KR2021/009255, filed Jul. 19, 2021, which claims priority to and the benefit of KR Patent Application No. 10-2020-0098364, filed Aug. 6, 2020, the disclosure of which is incorporated herein by reference in its entirety.

TECHNICAL FIELD

The present disclosure relates to a refrigerator which may prevent the formation of frost in the flow path of a frost detection device due to at least one of defrost water and other condensate generated during defrosting operation.

BACKGROUND

Generally, a refrigerator is an appliance that uses cold air to store items stored in storage space for a long time or while maintaining at a constant temperature.

The refrigerator is provided with a refrigeration system including one or more evaporators and is configured to generate and circulate the cold air.

Here, the evaporator serves to maintain air inside the refrigerator within a preset temperature range by exchanging heat between a low-temperature and low-pressure refrigerant and the air inside the refrigerator (cold air circulating inside the refrigerator).

While the evaporator is exchanging heat with the internal air of the refrigerator, frost may be formed in the evaporator due to at least one of water or moisture contained in the internal air and moisture present around the evaporator.

In a conventional technology, a defrosting operation is performed to remove frost formed on the surface of the evaporator when a certain time has elapsed after the operation of the refrigerator has started.

That is, in the conventional technology, the defrosting operation is performed through indirect estimation based on the operation time of the refrigerator, rather than directly detecting the amount of frost formed on the surface of the evaporator.

Accordingly, in the conventional technology, even if frost is not formed, the defrosting operation may be performed, thereby decreasing power consumption efficiency, or even if frost is excessively formed, the defrosting operation may not be performed.

Particularly, the defrosting operation is performed by operating a heater to increase a temperature around the evaporator, and after the defrosting operation is performed, the refrigerator is operated with a large load to rapidly reach a preset temperature therein, thereby causing high power consumption.

Accordingly, various studies are being conducted to shorten a period of time of the defrosting operation or the defrosting operation.

Recently, in order to accurately check the amount of frost formed on the surface of the evaporator, a method using temperature or pressure difference between the inlet side and outlet side of the evaporator has been proposed. This is disclosed in Korean Patent Application Publication Nos. 10-2019-0101669, 10-2019-0106201, 10-2019-0106242, 10-2019-0112482, and 10-2019-0112464.

That is, according to these documents, a frost detection flow path configured to have a flow of air is formed separately from the flow of air passing through an evaporator, and temperature difference change according to the difference of the amount of air passing through the frost detection flow path is measured to accurately determine the start time of the defrosting operation.

Meanwhile, as for the conventional technology, during defrosting operation, defrost water generated while ice formed in the evaporator melts may be introduced into the frost detection flow path.

Particularly, defrost water introduced into the frost detection flow path may not be completely discharged therefrom due to a sensor located in the frost detection flow path, and a portion of the defrost water may remain in the frost detection flow path, which may close the frost detection flow path or freeze the sensor.

That is, the frost detection flow path is narrow and long, and the frost detection flow path may be maintained at a temperature below zero even during defrosting operation, and thus defrost water may freeze while flowing down in the frost detection flow path.

However, according to the conventional technology, a structure for preventing the blockage of the frost detection flow path or the freezing of a sensor due to defrost water introduced into the frost detection flow path is not provided, and accordingly, the blockage of the frost detection flow path or the freezing of the sensor due to defrost water may occur.

Of course, in addition to defrost water, due to condensate caused by temperature difference in the frost detection flow path, the blockage of the frost detection flow path or the freezing of the sensor may occur.

Particularly, when a block of ice or water including thin ice is introduced into the frost detection flow path, the block of ice or water does not efficiently pass through the frost detection flow path, but may block the inside of the frost detection flow path or may be frozen therein.

In addition, even if a defrosting device for defrosting the evaporator is used, when ice is formed inside the frost detection flow path, the frost detection flow path is provided as a flow path separated from an external environment, and thus the defrosting of the inside of the frost detection flow path is extremely difficult. As a result, the frost detection flow path requires separate maintenance when frost is formed in the frost detection flow path.

SUMMARY

The present disclosure has been made keeping in mind the above problems and is intended to prevent the formation of frost in a flow path of a frost detection device due to defrost water or other condensate generated during defrosting operation.

In addition, the present disclosure is intended to prevent the formation of frost in the flow path of the frost detection device based on a controlling method, and also through structural improvement, thereby preventing the formation of frost more effectively.

In order to accomplish this, in a refrigerator of the present disclosure, a frost detection device may include a frost detection flow path which provides a flow path through which fluid moves.

In the refrigerator of the present disclosure, the frost detection device may include a frost check sensor which measures the physical property of fluid passing through the frost detection flow path.

In the refrigerator of the present disclosure, a defrosting device may include at least one of a first heater disposed near a fluid inlet of the frost detection flow path, a second heater disposed near a fluid outlet of the frost detection flow path, and a third heater disposed between the first heater and the second heater.

In the refrigerator of the present disclosure, the first heater may have a higher output than the second heater.

In the refrigerator of the present disclosure, the third heater may have a lower output than the first heater or the second heater. Accordingly, the formation of frost inside the frost detection flow path may be prevented by the heaters.

In the refrigerator of the present disclosure, the third heater may be provided as at least one of a heater and a heating element.

In the refrigerator of the present disclosure, at least a portion of the frost detection flow path may be disposed between a first duct and a cold air source. Accordingly, fluid flowing to the cold air source by being introduced into the first duct may partially flow into the frost detection flow path.

In the refrigerator of the present disclosure, at least a portion of the frost detection flow path may be disposed between a second duct and a storage compartment. Accordingly, fluid passing through the frost detection flow path may flow through the second duct to the storage compartment.

In the refrigerator of the present disclosure, the physical property of fluid measured by the frost detection device may include at least one of temperature, pressure, or flow rate.

In the refrigerator of the present disclosure, the frost check sensor may include a sensor.

In the refrigerator of the present disclosure, the frost check sensor may include a sensing inductor.

In the refrigerator of the present disclosure, the sensing inductor may be configured as a means for inducing the improvement of precision when measuring physical properties.

In the refrigerator of the present disclosure, the sensing inductor constituting the frost detection device may include a heating element which generates heat.

In the refrigerator of the present disclosure, the sensor constituting the frost detection device may measure the temperature of heat. Accordingly, the frost detection device may measure a temperature difference value $\Delta Ht$ (a logic temperature) according to a fluid flow rate.

In the refrigerator of the present disclosure, the sensing inductor of the frost check sensor may be used as the third heater in the frost detection flow path. Accordingly, the sensing inductor as one heating element may sense the physical properties of frost to detect the formation of frost. The one heating element may prevent freezing of defrost water flowing in the frost detection flow path during defrosting operation.

In the refrigerator of the present disclosure, the cold air source may include at least one of a thermoelectric module and an evaporator.

In the refrigerator of the present disclosure, the thermoelectric module may include a thermoelectric element.

In the refrigerator of the present disclosure, the fluid outlet of the frost detection flow path may have a larger opening area than the fluid inlet. The fluid outlet may maintain a temperature higher than the fluid inlet.

In the refrigerator of the present disclosure, when the physical property reaches a set value, the defrosting operation may be performed. Accordingly, the defrosting operation may be performed at the accurate time at which defrosting is required.

In the refrigerator of the present disclosure, during defrosting operation, at least one of the first heater, the second heater, or the third heater may be operated.

In the refrigerator of the present disclosure, during defrosting operation, the third heater may operate such that the internal temperature of the frost detection flow path may be maintained at a temperature of 0° C. or more. Accordingly, the blockage of the inside of the frost detection flow path or the freezing of a sensor may be prevented.

In the refrigerator of the present disclosure, a part having the lowest temperature of temperatures inside the frost detection flow path may be configured to be more adjacent to the first heater than the second heater. Accordingly, even the part having the lowest temperature inside the frost detection flow path may be maintained at a temperature of 0° C. or more during defrosting operation.

In the refrigerator of the present disclosure, during defrosting operation, the fluid outlet of the frost detection flow path may be configured to have a temperature having maximum value. Accordingly, the blockage of the fluid outlet may be prevented.

In the refrigerator of the present disclosure, the frost check sensor may be located to be closer to the fluid outlet of the frost detection flow path than the fluid inlet thereof. Accordingly, the freezing of the frost check sensor may be prevented.

In the refrigerator of the present disclosure, the third heater may be provided in the frost check sensor. Accordingly, the frost check sensor may sense the physical property of fluid and may perform the function of preventing the freezing of defrost water flowing in the frost detection flow path during defrosting operation.

In the refrigerator of the present disclosure, during defrosting operation, the third heater may be configured to generate heat. Accordingly, even if defrost water flows into the frost detection flow path, the freezing of the defrost water may be prevented.

In the refrigerator of the present disclosure, during defrosting operation, a part at which the frost check sensor is located may be configured to maintain a temperature higher than the temperature of a center portion between the frost check sensor and the fluid outlet. Accordingly, the freezing of the frost check sensor may be prevented.

In the refrigerator of the present disclosure, the third heater may be located to be closer to the fluid outlet of the frost detection flow path than the fluid inlet thereof. Accordingly, the freezing of the fluid outlet may be prevented.

In the refrigerator of the present disclosure, during defrosting operation, a part at which the third heater is located may be configured to maintain a temperature higher than the temperature of the center portion between the frost check sensor and the fluid outlet. Accordingly, the freezing of the frost check sensor may be prevented.

In the refrigerator of the present disclosure, each of the heaters may be configured to maintain the internal temperature of the frost detection flow path at a temperature of 0° C. or more during defrosting operation. Accordingly, the freezing of the inside of the frost detection flow path may be prevented.

As described above, according to the refrigerator of the present disclosure, the third heater may be provided in the frost detection flow path, thereby preventing the freezing of the inside of the frost detection flow path during the defrosting of the cold air source.

According to the refrigerator of the present disclosure, the first heater and the second heater may be disposed such that heat may be sufficiently provided to the fluid inlet and fluid outlet of the frost detection flow path, or the fluid inlet and the fluid outlet may be disposed according to the arrangement of the first heater and the second heater, thereby maintaining the inside of the frost detection flow path at a temperature above zero during defrosting operation.

According to the refrigerator of the present disclosure, the frost check sensor may include the third heater and may be used to detect frost formation and maintain the inside of the frost detection flow path at a temperature above zero during defrosting operation, thereby minimizing components provided in the frost detection flow path, and preventing the blockage of the inside of the frost detection flow path.

According to the refrigerator of the present disclosure, the fluid outlet of the frost detection flow path may be configured to maintain a temperature higher than the temperature of the fluid inlet, thereby preventing the freezing of a temperature sensor in cooperation with the third heater relatively adjacent to the fluid outlet of the frost detection flow path.

DESCRIPTION OF DRAWINGS

FIG. 1 is a front view schematically illustrating an internal configuration of a refrigerator according to the embodiment of the present disclosure.

FIG. 2 is a vertical sectional view schematically illustrating the configuration of the refrigerator according to the embodiment of the present disclosure.

FIG. 3 is a state view schematically illustrating the state of operation performed according to an operation reference value relative to a reference temperature set by a user for each storage compartment of the refrigerator according to the embodiment of the present disclosure.

FIG. 4 is a view schematically illustrating the structure of a thermoelectric module according to the embodiment of the present disclosure.

FIG. 5 is a block diagram schematically illustrating a refrigeration cycle of the refrigerator according to the embodiment of the present disclosure.

FIG. 6 is a sectional view illustrating the rear space of a second storage compartment in a casing for illustrating the installation state of a frost detection device and an evaporator constituting the refrigerator according to the embodiment of the present disclosure.

FIG. 7 is a front perspective view of a fan duct assembly for illustrating the installation state of the frost detection device constituting the refrigerator according to the embodiment of the present disclosure.

FIG. 8 is a rear perspective view of the fan duct assembly for illustrating the installation state of the frost detection device constituting the refrigerator according to the embodiment of the present disclosure.

FIG. 9 is a block diagram schematically illustrating a control structure of the refrigerator according to the embodiment of the present disclosure.

FIG. 10 is a view illustrating the installed structure of a second evaporator of the refrigerator and defrosting devices provided therein according to the embodiment of the present disclosure.

FIG. 11 is an exploded perspective view illustrating a state in which a flow path cover and a sensor are separated from the fan duct assembly of the refrigerator according to the embodiment of the present disclosure.

FIG. 12 is a rear view of the fan duct assembly for illustrating the installation state of the frost detection device constituting the refrigerator according to the embodiment of the present disclosure.

FIG. 13 is an enlarged view illustrating the installation state of the frost detection device constituting the refrigerator according to the embodiment of the present disclosure.

FIG. 14 is an enlarged view illustrating a state in which the flow path cover is removed to illustrate the internal state of the frost detection flow path of the frost detection device constituting the refrigerator according to the embodiment of the present disclosure.

FIG. 15 is an enlarged perspective view illustrating the installation state of the frost detection device constituting the refrigerator according to the embodiment of the present disclosure.

FIG. 16 is a graph illustrating a temperature of each internal portion of the frost detection flow path constituting the refrigerator during defrosting operation according to the embodiment of the present disclosure.

FIG. 17 is a graph illustrating a temperature of each internal portion of the frost detection flow path constituting the refrigerator during cooling operation according to the embodiment of the present disclosure.

FIG. 18 is an enlarged view illustrating the installation state of the frost detection device according to the embodiment of the present disclosure.

FIG. 19 is a view schematically illustrating the frost check sensor of the frost detection device according to the embodiment of the present disclosure.

FIG. 20 is a view illustrating a temperature change in the frost detection flow path according to on/off of a third heater and on/off of each cooling fan immediately after defrosting of the evaporator of the refrigerator is completed according to the embodiment of the present disclosure.

FIG. 21 is a flowchart illustrating a control process by a controller during the frost detection operation of the refrigerator according to the embodiment of the present disclosure.

FIG. 22 is a view illustrating a temperature change in the frost detection flow path according to the on/off of the heating element and the on/off of each cooling fan while frost is formed in the evaporator of the refrigerator according to the embodiment of the present disclosure.

DETAILED DESCRIPTION

The present disclosure describes a structure that is intended to prevent the formation of frost inside a frost detection flow path of a frost detection device due to defrost water or condensate generated during defrosting operation.

That is, according to the present disclosure, each of a first heater, a second heater, and a third heater may be provided as a defrosting device, and the third heater may be located inside the frost detection flow path and may be configured to generate heat during defrosting operation.

Accordingly, due to the defrosting operation, the inside of the frost detection flow path may be prevented from being blocked, or freezing of the frost check sensor provided in the frost detection flow path may be prevented.

The exemplary embodiments of the structure and operation control of the refrigerator of the present disclosure will be described with reference to FIGS. 1 to 22.

FIG. 1 is a front view schematically illustrating an internal configuration of the refrigerator according to the embodiment of the present disclosure, and FIG. 2 is a vertical sectional view schematically illustrating the configuration of the refrigerator according to the embodiment of the present disclosure.

As illustrated in these drawings, the refrigerator 1 according to the embodiment of the present disclosure may include a casing 11.

The casing 11 may include an outer casing 11*b* constituting the exterior of the refrigerator 1.

In addition, the casing 11 may include an inner casing 11*a* constituting the inner wall surface of the refrigerator 1. A storage compartment in which items are stored may be provided in the inner casing 11*a*.

The storage compartment may include only one storage compartment or at least two storage compartments. In the embodiment of the present disclosure, for example, the storage compartment may include two storage compartments in which items are stored in temperatures different from each other.

The storage compartment may include a first storage compartment 12 maintained at a first set reference temperature.

The first set reference temperature may be a temperature at which stored items do not freeze, and may be in the range of a temperature lower than a temperature (a room temperature) outside the refrigerator 1.

For example, the first set reference temperature may be set in a temperature range of 32° C. or less and above 0° C. Of course, the first set reference temperature may be set to be higher than 32° C., or 0° C. or less when needed (for example, according to a room temperature or the type of a stored item).

Particularly, the first set reference temperature may be the internal temperature of the first storage compartment 12 set by a user, and when the user does not set the first set reference temperature, an arbitrarily designated temperature may be used as the first set reference temperature.

The first storage compartment 12 may be configured to operate with a first operation reference value to maintain the first set reference temperature.

The first operation reference value may be set as a temperature range value including a first lower limit temperature NT−DIFF1. For example, when the internal temperature of the first storage compartment 12 reaches the first lower limit temperature NT−DIFF1 relative to the first set reference temperature, operation for supplying cold air stops.

The first operation reference value may be set as a temperature range value including a first upper limit temperature NT+DIFF1. For example, when the internal temperature rises relative to the first set reference temperature, the operation for supplying cold air may restart before the internal temperature reaches the first upper limit temperature NT+DIFF1.

Accordingly, the supplying of cold air into the first storage compartment 12 may be performed or stopped in consideration of the first operation reference value for the first storage compartment based on the first set reference temperature.

The set reference temperature NT and the operation reference value DIFF are illustrated in FIG. 3.

In addition, the storage compartment may include a second storage compartment 13 maintained at a second set reference temperature.

The second set reference temperature may be lower than the first set reference temperature. In this case, the second set reference temperature may be set by a user, and when the user does not set the second set reference temperature, an arbitrarily designated temperature may be used as the second set reference temperature.

The second set reference temperature may be a temperature at which a stored item can freeze. For example, the second set reference temperature may be set in a temperature range of 0° C. or less and −24° C. or more. Of course, the second set reference temperature may be set to be higher than 0° C. or −24° C. or less when needed (for example, according to the room temperature or the type of a stored item).

The second set reference temperature may be the internal temperature of the second storage compartment 13 set by a user, and when the user does not set the second preset reference temperature, an arbitrarily designated temperature may be used as the second set reference temperature. The second storage compartment 13 may be configured to operate with a second operation reference value to maintain the second set reference temperature.

The second operation reference value may be set as a temperature range value including a second lower limit temperature NT−DIFF2. For example, when the internal temperature of the second storage compartment 13 reaches the second lower limit temperature NT−DIFF2 relative to the second set reference temperature, operation for supplying cold air stops.

The second operation reference value may be set as a temperature range value including a second upper limit temperature NT+DIFF2. For example, when the internal temperature of the second storage compartment 13 rises relative to the second set reference temperature, operation for supplying cold air may restart before the internal temperature reaches the second upper limit temperature NT+DIFF2.

Accordingly, in consideration of the second operation reference value for the second storage compartment based on the second set reference temperature, the supplying of cold air into the second storage compartment 13 may be performed or stopped.

The first operation reference value may be set to have a smaller range between the upper limit temperature and lower limit temperature than a range between the upper limit temperature and lower limit temperature of the second operation reference value. For example, the second upper limit temperature NT+DIFF2 and second lower limit temperature NT−DIFF2 of the second operation reference value may be set as ±2.0° C., and the first upper limit temperature NT+DIFF1 and first lower limit temperature NT−DIFF1 of the first operation reference value may be set as ±1.5° C.

Meanwhile, the storage compartments described above may be configured such that fluid circulates in each of the storage compartments so that the internal temperature thereof is maintained.

The fluid may be air. In description below, as an example, fluid that circulates through the storage compartment is air. Of course, the fluid may be a gas other than air.

A temperature (a room temperature) outside the storage compartment may be measured by a first temperature sensor 1*a* as illustrated in FIG. 9, and the internal temperature may be measured by a second temperature sensor 1*b*.

The first temperature sensor 1*a* and the second temperature sensor 1*b* may be configured separately. Of course, the room temperature and the internal temperature may be measured by the same one temperature sensor, or by at least two temperature sensors in cooperation with each other.

In addition, the storage compartment 12 or 13 may include the door 12*b* or 13*b*.

The door 12*b* or 13*b* may function to open and close the storage compartment 12 or 13, and may be configured as a swinging opening/closing structure or a drawer-type opening/closing structure.

The door 12*b* or 13*b* may include one door or at least two doors.

Next, the refrigerator 1 according to the embodiment of the present disclosure may include a cold air source.

The cold air source may include a structure which generates cold air.

The cold air generation structure of the cold air source may be variously formed.

For example, the cold air source may include a thermoelectric module 23.

As illustrated in FIG. 4, the thermoelectric module 23 may include a thermoelectric element 23*a* including a heat absorbing surface 231 and a heat discharging surface 232. The thermoelectric module 23 may be configured as a module including a sink 23*b* connected to at least one of the heat absorbing surface 231 and the heat discharging surface 232 of the thermoelectric element 23*a*.

In the embodiment of the present disclosure, the cold air generation structure of the cold air source may be an evaporator 21 or 22.

The evaporator 21 or 22 may constitute a refrigeration system together with the compressor 60 (see FIG. 5) and may function to exchange heat with air passing through the associated evaporator so as to lower the temperature of the air.

When the storage compartment includes the first storage compartment 12 and the second storage compartment 13, the evaporator may include the first evaporator 21 for supplying cold air to the first storage compartment 12, and a second evaporator 22 for supplying cold air to the second storage compartment 13.

In this case, inside the inner casing 11*a*, the first evaporator 21 may be located at a rear side of the inside of the first storage compartment 12, and the second evaporator 22 may be located at a rear side of the inside of the second storage compartment 13.

Of course, although not shown, one evaporator may be provided in only one storage compartment of the first storage compartment 12 and the second storage compartment 13.

Even if the refrigerator includes two evaporators, the compressor 60 constituting an associated refrigeration cycle may be only one compressor. In this case, as illustrated in FIG. 5, the compressor 60 may be connected to the first evaporator 21 to supply a refrigerant through a first refrigerant passage 61 to the first evaporator 21, and may be connected to the second evaporator 22 to supply a refrigerant through a second refrigerant passage 62 to the second evaporator 22. In this case, each of the refrigerant passages 61 and 62 may be selectively opened/closed by a refrigerant valve 63.

The refrigerator may include a structure for supplying the generated cold air to the storage compartment.

The cold air supply structure may include a cooling fan. The cooling fan may be configured to perform the function of supplying cold air generated by passing through the cold air source to the storage compartments 12 and 13.

In this case, the cooling fan may include a first cooling fan 31 which supplies cold air generated by passing through the first evaporator 21 to the first storage compartment 12.

The cooling fan may include a second cooling fan 41 which supplies cold air generated by passing through the second evaporator 22 to the second storage compartment 13.

Next, the refrigerator 1 according to the embodiment of the present disclosure may include a first duct.

The first duct may be formed as at least one of a passage (e.g., a tube such as a duct or a pipe), a hole, and an air flow path through which air passes. Air may flow from the inside of the storage compartment to the cold air source under the guidance of the first duct.

With reference to FIG. 6, the first duct may include an introduction duct 42*a*. That is, fluid flowing through the second storage compartment 13 may flow into the second evaporator 22 by the guidance of the introduction duct 42*a*. In addition, the first duct may include a portion of the bottom surface of the inner casing 11*a*. In this case, the portion of the bottom surface of the inner casing 11*a* may be a portion may be a portion ranging from a portion facing the bottom surface of the introduction duct 42*a* to a position at which the second evaporator 22 is mounted. Accordingly, the first duct may provide a flow path through which fluid flows from the introduction duct 42*a* toward the second evaporator 22.

Next, the refrigerator 1 according to the embodiment of the present disclosure may include a second duct.

The second duct may be formed as at least one of a passage (e.g., a tube such as a duct or a pipe, etc.), a hole, and an air flow path which guides air around the evaporator 21 or 22 to be moved to the storage compartment.

The second duct may include the fan duct assembly 30 and 40 located in front of the evaporator 21 and 22.

As illustrated in FIGS. 1 and 2, the fan duct assembly 30 and 40 may include at least one fan duct assembly of a first fan duct assembly 30 which guides the flow of cold air in the first storage compartment 12 and a second fan duct assembly 40 which guides the flow of cold air in the second storage compartment 13.

In this case, space between the fan duct assemblies 30 and 40 in which the evaporators 21 and 22 are respectively located and the rear wall surface of the inner casing 11*a* may be defined as a heat exchange flow path in which air exchanges heat with the evaporators 21 and 22.

Of course, although not shown, even if a evaporator is provided only in one of the storage compartment, the fan duct assemblies 30 and 40 may be provided in the storage compartments 12 and 13, respectively, and even if the evaporators 21 and 22 are provided in the storage compartments 12 and 13, respectively, only one of the fan duct assemblies 30 and 40 may be provided. Various configurations are possible.

Meanwhile, in the embodiment described below, for example, the cold air generation structure of the cold air source may be the second evaporator 22, the cold air supply structure for the cold air source may be the second cooling fan 41, the first duct may be the introduction duct 42*a* formed in the second fan duct assembly 40, and the second duct may be the second fan duct assembly 40.

As illustrated in FIGS. 6 and 7, the second fan duct assembly 40 may include a grille panel 42.

In this case, the grille panel 42 may have the introduction duct 42*a* into which air is introduced from the second storage compartment 13.

The introduction duct 42*a* may be formed on each of the opposite ends of the lower side of the grille panel 42 and may be configured to guide the intake flow of air flowing on an inclined edge portion between the bottom surface and rear wall surface of the inside of the inner casing 11*a* due to a machine room.

In this case, the introduction duct 42*a* may be used as a part of the structure of the first duct described above. That is, the introduction duct 42*a* may guide air in the second storage compartment 13 to move to the second evaporator 22.

As illustrated in FIGS. 6 and 8, the second fan duct assembly 40 may include a shroud 43.

The shroud 43 may be coupled to the rear surface of the grille panel 42. A flow path for guiding the flow of cold air to the second storage compartment 13 may be provided between the shroud 43 and the grille panel 42.

A fluid inflow hole 43*a* may be formed in the shroud 43. That is, after cold air passing through the second evaporator 22 is introduced into the flow path for the flow of cold air located between the grille panel 42 and the shroud 43 through the fluid inflow hole 43*a*, the cold air may pass through each cold air discharge hole 42*b* of the grille panel 42 under the guidance of the flow path and may be discharged into the second storage compartment 13.

The cold air discharge hole 42*b* may include at least two cold air discharge holes. For example, as illustrated in FIGS. 6 and 7, the cold air discharge hole 42*b* may be formed on each of opposite side portions of the upper, middle, lower parts of the grille panel 42.

The second evaporator 22 may be configured to be located under the fluid inflow hole 43*a*.

Meanwhile, the second cooling fan 41 may be installed in a flow path between the grille panel 42 and the shroud 43.

Preferably, the second cooling fan 41 may be installed in the fluid inflow hole 43*a* formed in the shroud 43. That is, due to the operation of the second cooling fan 41, air in the second storage compartment 13 may sequentially pass through the introduction duct 42*a* and the second evaporator 22 and then may be introduced to the fluid inflow hole 43*a* through the flow path.

Next, the refrigerator 1 according to the embodiment of the present disclosure may include the defrosting device 50. The defrosting device 50 is a component that provides a heat source to remove frost formed on the cold air source (e.g., the second evaporator). Of course, the defrosting device 50 may perform the function of defrosting the frost detection device 70 or the function of preventing the freezing of the frost detection device 70.

As illustrated in FIGS. 9 and 10, the defrosting device may include the first heater 51.

That is, heat generated by the first heater 51 may remove frost formed on the second evaporator 22 (the cold air source).

The first heater 51 may be located at a lower side (an air inflow side) of the second evaporator 22. That is, heat generated by the first heater 51 may be provided from the lower end of the second evaporator 22 to an upper end thereof in the direction of air flow.

Of course, although not shown, the first heater 51 may be located at a side portion of the second evaporator 22, in front of or behind the second evaporator 22, or above the second evaporator 22, or may be located to be in contact with the second evaporator 22.

The first heater 51 may be configured as a sheath heater. That is, frost formed on the second evaporator 22 is removed by using the radiant heat and convection heat of the sheath heater.

In addition, the defrosting device 50 may include the second heater 52.

The second heater 52 may be a heater that provides heat to the second evaporator 22 while generating the heat with a lower output than the output of the first heater 51.

As illustrated in FIG. 10, the second heater 52 may be located to be in contact with heat exchange fins of the second evaporator 22. That is, the second heater 52 may be in direct contact with the second evaporator 22 so that the second heater 52 may remove frost formed on the second evaporator 22 through heat conduction.

The second heater 52 may be formed as an L-cord heater. That is, frost formed on the second evaporator 22 may be removed by the conduction heat of the L-cord heater.

In this case, the second heater 52 may be installed to be in contact with the heat exchange fins located on the upper portion (an air outflow side) of the second evaporator 22.

In addition, the defrosting device 50 may include the third heater 53 (see FIG. 9).

The third heater 53 may be provided to prevent the freezing of the frost detection device 70.

That is, the third heater 53 may generate heat during defrosting operation and may prevent defrost water flowing down to the frost detection device 70 from freezing in the frost detection device 70 or from blocking a flow path.

The third heater 53 may be provided in the frost detection flow path 710 constituting the frost detection device 70.

Particularly, the third heater 53 may be located to be more adjacent to a fluid outlet 712 of the frost detection flow path 710 than to a fluid inlet 711 thereof. Accordingly, the temperature of defrost water flowing into the fluid outlet may be increased as much as possible such that the defrost water may be prevented from freezing until the defrost water is completely discharged from the frost detection flow path 710.

The third heater 53 may be configured as at least any one of a heater and a heating element having lower outputs than at least any one heater of the first heater 51 and the second heater 52.

In addition, the third heater 53 may generate heat when controlling operation for detecting the formation of frost and when performing defrosting operation.

That is, while the third heater 53 generates heat when controlling operation for detecting the formation of frost, a physical property of fluid for detecting the formation of frost may be checked, and due to the heat generation during the defrosting operation, defrosting a surrounding frozen portion or preventing the freezing of defrost water flowing down to the frost detection device 70 may be selectively performed.

Meanwhile, the defrosting device 50 may be provided with only any one of the first heater 51 and the second heater 52.

In this case, any one heater of the first heater 51 and the second heater 52 may be used to defrost the cold air source, and the third heater 53 may be used to defrost the frost detection device 70.

Of course, the first heater 51 or the second heater 52 may additionally perform a role of assisting the defrosting of the frost detection device 70.

In addition, during the defrosting operation for defrosting the second evaporator 22, the heating of each of the heaters 51, 52, and 53 may be controlled such that the inside of the frost detection flow path 710, to be described later, is maintained at a temperature of 0° C. or more.

That is, due to the control of heating of each of the heaters 51, 52, and 53, during defrosting operation, the inside of the frost detection flow path 710 may maintain a temperature above zero at all times, and defrost water flowing down in the associated frost detection flow path 710 may be prevented from freezing to close a flow path or the frost check sensor 730 may be prevented from freezing.

In addition, the defrosting device 50 may include a temperature sensor for an evaporator (not shown).

The temperature sensor for an evaporator may detect a temperature around the defrosting device 50, and this detected temperature value may be used as a factor in determining the turning on/off of each of the heaters 51, 52, and 53.

For example, when a temperature value detected by the temperature sensor for an evaporator reaches a specific temperature (a defrosting end temperature) after each of the heaters 51, 52, and 53 is turned on, each of the heaters 51, 52, and 53 may be turned off.

The defrosting end temperature may be set as an initial temperature, and when remaining ice is detected in the second evaporator 22, the defrosting end temperature may be increased by a predetermined temperature.

Next, the refrigerator 1 according to the embodiment of the present disclosure may include the frost detection device 70.

The frost detection device 70 may be a device which detects the amount of frost or ice formed on the cold air source.

FIG. 6 is a sectional view illustrating the installation states of the frost detection device and the evaporator according to the embodiment of the present disclosure, and FIGS. 8 and FIGS. 11 to 15 illustrate a state in which the frost detection device is installed in the second fan duct assembly.

As in the embodiment illustrated in these drawings, the frost detection device according to the embodiment of the present disclosure is a device which is located in the flow path of fluid guided by the introduction duct 42*a* (the first duct) and the second fan duct assembly 40 (the second duct) and detects the frost on the second evaporator 22 (the cold air source).

In addition, the frost detection device 70 may recognize the degree of frost formed on the second evaporator 22 by using a sensor which outputs different values according to the physical property of fluid. In this case, the physical property may include at least one of a temperature, pressure, and a flow rate.

The frost detection device 70 may be configured such that the execution time of defrosting operation based on the degree of the recognized frost formation may be accurately known.

As illustrated in FIG. 11, the frost detection device 70 may include the frost detection flow path 710.

The frost detection flow path 710 may provide a passage (a flow path) through which air flows. The frost detection flow path 710 may be provided as a part in which the frost check sensor 730 for checking frost formed on the second evaporator 22 is located.

The frost detection flow path 710 may be configured as a flow path for guiding an air flow separated from the flow of air passing through the second evaporator 22 and the flow of air in the second fan duct assembly 40.

At least a portion of the frost detection flow path 710 may be located in at least one portion of the flow path of cold air circulating through the second storage compartment 13, the introduction duct 42*a*, the second evaporator 22, and the second fan duct assembly 40.

Preferably, at least a portion of the frost detection flow path 710 may be disposed in an introduction flow path through which fluid flows toward the cold air source through the first duct.

For example, the fluid inlet 711 of the frost detection flow path 710 may be disposed in a flow path formed between the introduction duct 42*a* (the first duct) and the second evaporator 22 (the cold air source).

In addition, the frost detection flow path 710 may be formed by being recessed from a surface of the grille panel 42 constituting the second fan duct assembly 40 which faces the second evaporator 22 to flow air in the frost detection flow path 710.

In this case, as illustrated in FIG. 7, the frost detection flow path 710 may be formed by protruding forward from the grille panel 42.

Of course, although not shown, after the frost detection flow path 710 is manufactured as a tube body separate from the grille panel 42, the frost detection flow path 710 may be fixed (attached or coupled) to the grille panel 42, or may be formed on or coupled to the shroud 43.

The frost detection flow path 710 may be configured to be open at a rear portion thereof facing the second evaporator 22, and in the open rear portion, a remaining portion except for the fluid inlet 711 and the fluid outlet 712 may be configured to be closed by a flow path cover 720.

Preferably, as illustrated in FIGS. 6 and 12, the fluid inlet 711 of the frost detection flow path 710 may be located to be open to a flow path through which air flows through the introduction duct 42*a* to the air inflow side of the second evaporator 22.

That is, a portion of air introduced into the air inlet of the second evaporator 22 through the introduction duct 42*a* may be introduced into the frost detection flow path 710.

At least a portion of the frost detection flow path 710 may be disposed in a flow path formed between the second fan duct assembly 40 (the second duct) and the second storage compartment 13.

Preferably, the fluid outlet 712 of the frost detection flow path 710 may be located between the air outflow side of the second evaporator 22 and a flow path through which cold air is supplied to the second storage compartment 13.

More specifically, as illustrated in FIGS. 6 and 12, the fluid outlet 712 of the frost detection flow path 710 may be located to be open to a flow path through which air flows to the fluid inflow hole 43*a* of the shroud 43 through the second evaporator 22.

That is, air passing through the frost detection flow path 710 may directly flow to a position between the air outflow side of the second evaporator 22 and the fluid inflow hole 43*a* of the shroud 43.

FIGS. 13 to 15 illustrate the frost detection flow path 710 in detail.

Each portion inside the frost detection flow path 710 may be configured to maintain a different temperature range.

That is, during defrosting operation, the fluid inlet 711 and the fluid outlet 712 may be influenced by the first heater 51 and the second heater 52 provided to be adjacent thereto. Since the temperature of the fluid inlet 711 and the temperature of the fluid outlet 712 are different from each other, the temperature of each portion of a flow path in the frost detection flow path 710 may also be influenced by the temperature of the fluid inlet 711 and the temperature of the fluid outlet 712.

Substantially, the inside of the frost detection flow path 710 tends to gradually decrease in temperature going toward the center of the inside of the frost detection flow path 710 (a center when viewed in a longitudinal direction of the frost detection flow path), and this is illustrated in the graphs of FIGS. 16 and 17.

Furthermore, the third heater 53 provided in the frost detection flow path 710 may influence the temperature of each portion in the frost detection flow path 710.

In consideration of this, a portion P4 having the lowest temperature inside the frost detection flow path 710 may be disposed to be more adjacent to the first heater 51 (or the fluid outlet) than to the second heater 52 (or the fluid inlet). That is, the first heater 51 may generate heat with a higher output than the second heater 52 such that the temperature of the portion having the lowest temperature may be increased a little more.

In this case, the portion having the lowest temperature may be a center portion between the third heater 53 and the fluid inlet 711.

As illustrated in FIG. 16, in the frost detection flow path 710, the temperature of a portion P3 (a portion at which the frost check sensor is located) at which the third heater 53 is located, during defrosting operation, may be higher than the temperature of the portion P4 between the frost check sensor 730 and the fluid inlet 711.

This can be seen through a graph illustrating the temperature of each portion in the frost detection flow path 710 during the defrosting operation.

In this case, P1 in FIGS. 14, 16, and 17 is located at the fluid outlet 712, P2 is located at the fluid inlet 711, and P3 is located at the third heater 53. P31 is located at an air inflow side of the third heater 53, P32 is located at an air outflow side of the third heater 53, and P4 is located at a center between the frost check sensor 730 and the fluid inlet 711.

As in the graph illustrating the temperature of each portion in the frost detection flow path during normal cooling operation as illustrated in FIG. 17, the first heater 51 and the second heater 52 do not generate heat during normal cooling operation, so the temperature of a portion in the frost detection flow path 710 may be a temperature below zero.

Of course, unlike the graph of FIG. 17 during the cooling operation described above, the third heater 53 may frequently operate for frost detection, and the position of P3 or P4 having a temperature range below zero may have a temperature range above zero for an instant.

Particularly, as illustrated in FIGS. 13 and 14, an opening area provided by the fluid outlet 712 of the frost detection flow path 710 may be larger than an opening area provided by the fluid inlet 711 of the frost detection flow path 710.

That is, the opening area of the fluid outlet 712 of the frost detection flow path 710 may be formed as large as possible such that the temperature of the associated portion may be maintained higher than the temperatures of other portions during defrosting operation, and accordingly, the third heater 53 and the temperature sensor 732 which are located to be relatively adjacent to the fluid outlet 712 of the frost detection flow path 710 may be prevented from freezing.

The fluid inlet 711 of the frost detection flow path 710 may be configured to be influenced by the first heater 51, and the fluid outlet 712 of the frost detection flow path 710 may be configured to be influenced by the second heater 52.

That is, the position and opening direction of the fluid inlet 711 may be determined so that the fluid inlet may efficiently receive heat convected by the heating of the first heater 51, and the position and opening direction of the fluid outlet 712 may be determined so that the fluid outlet may efficiently receive heat discharged while being conducted to the second evaporator 22 by the heating of the second heater 52.

Meanwhile, as the amount of frost formed on the second evaporator 22 increases and the flow of air passing through the second evaporator 22 is gradually blocked, pressure difference between the air inflow side and the air outflow side of the second evaporator 22 may gradually increase, and due to the pressure difference, the amount of air introduced into the frost detection flow path 710 may gradually increase.

As the amount of air introduced into the frost detection flow path 710 increases, the temperature of the third heater 53 constituting the frost check sensor 730 to be described later may decrease, and a temperature difference value (hereinafter, referred to as "a logic temperature") between the turning on and off of the third heater 53 may decrease.

In consideration of this, it may be known that as the logic temperature ΔHt of the inside of the frost detection flow path 710 checked by the frost check sensor 730 decreases, the amount of the frost formed on the second evaporator 22 increases.

When frost does not exist in the second evaporator 22 or the amount of frost is remarkably small therein, most of air may pass through the second evaporator 22 in heat exchange space. On the other hand, some of the air may flow into the frost detection flow path 710.

For example, based on a state in which frost is not formed on the second evaporator 22, about 98% of air introduced through the introduction duct 42*a* may pass through the second evaporator 22 and the remaining 2% of the air may pass through the frost detection flow path 710.

In this case, the amount of air passing through the second evaporator 22 and the frost detection flow path 710 may gradually vary according to the amount of frost formed on the second evaporator 22.

For example, when frost is formed on the second evaporator 22, the amount of air passing through the second evaporator 22 may decrease but the amount of air passing through the frost detection flow path 710 may increase.

That is, the amount of air passing through the frost detection flow path 710 when frost is formed on the second evaporator 22 may be significantly larger than the amount of air passing through the frost detection flow path 710 before frost is formed on the second evaporator 22.

Particularly, it may be preferable to configure the frost detection flow path 710 such that the change of the air amount according to the amount of frost formed on the second evaporator 22 may be at least twice. That is, in order to determine the amount of formed frost by using the air amount, the change of the air amount should be at least twice to discriminate the change.

When the amount of frost formed in the second evaporator 22 is large enough to require the defrosting operation, the frost of the second evaporator 22 may act as flow resistance, and thus the amount of air flowing through the heat exchange space of the associated evaporator 22 may decrease, and the amount of air flowing through the frost detection flow path 710 may increase.

Accordingly, according to the amount of frost formed on the second evaporator 22, the amount of air flowing through the frost detection flow path 710 may change.

In addition, the frost detection device 70 may include the frost check sensor 730.

The frost check sensor 730 may be provided to measure the physical property of fluid passing through the frost detection flow path 710. In this case, the physical property may include at least one of a temperature, pressure, and a flow rate.

The frost check sensor 730 may be configured to calculate the amount of frost formed on the second evaporator 22 based on the difference of an output value changing according to the physical property of air (fluid) passing through the frost detection flow path 710.

That is, based on the difference of an output value checked by the frost check sensor 730, the amount of frost formed on the second evaporator 22 may be used for determining whether the defrosting operation is necessary.

In the embodiment of the present disclosure, the frost check sensor 730 may be provided to use temperature difference according to the amount of air passing through the frost detection flow path 710 such that the amount of frost formed on the second evaporator 22 is checked.

For example, as illustrated in FIG. 18, the frost check sensor 730 may be provided in a portion of the frost detection flow path 710 in which fluid flows, and thus the amount of frost formed on the second evaporator 22 may be checked based on an output value changing according to a fluid flow rate in the frost detection flow path 710. The output value may be variously determined by the temperature difference, pressure difference, and other characteristic difference.

As illustrated in FIG. 14, the frost check sensor 730 may be configured to be located closer to the fluid outlet 712 of the frost detection flow path 710 than to the fluid inlet 711 of the frost detection flow path 710.

This is because in a process in which air introduced into the frost detection flow path 710 through the fluid inlet 711 flows through the fluid outlet 712, from the time at which the air reaches the center portion of the frost detection flow path 710, the flow of the associated air begins to be stabilized.

However, when it is considered that the change of air flow is large again at the fluid outlet 712, it may be preferable that in a distance between the fluid inlet 711 and the fluid outlet 712 of the frost detection flow path 710, the frost check sensor 730 is located at a position of approximately ⅔ to ¾ of the distance from the fluid inlet 711.

Of course, it is more preferable that the position of the frost check sensor 730 is designed by considering the width of the flow path of the frost detection flow path 710 as well.

As illustrated in FIG. 19, the frost check sensor 730 may include a sensing inductor.

The sensing inductor may be a means for inducing the measurement accuracy of the sensor (the temperature sensor) to be improved such that the sensor may more accurately measure the physical property (or an output value).

In the embodiment of the present disclosure, the third heater 53 constituting the defrosting device 50 is configured as the sensing inductor as an example.

That is, the sensor may measure temperature change in the frost detection flow path 710 caused by the heat of the third heater 53 so that whether frost is formed may be recognized.

Of course, the sensing inductor may be configured as a heating element separate from the third heater 53 and may be provided in the frost detection flow path. That is, the heating element may be used for detecting the formation of frost, and the third heater 53 may be used only for defrosting the frost detection device 70

However, when considering an installation structure such as the narrow internal space of the frost detection flow path 710 and a power line connected for the sensing inductor, only minimum components are preferably provided in the frost detection flow path 710. To this end, it may be more preferable that the third heater 53 also performs the function of the sensing inductor such that the third heater 53 and the sensing inductor are unified into one component.

According to the embodiment of the present disclosure, the frost check sensor 730 may include the temperature sensor 732.

The temperature sensor 732 is a sensing element that measures a temperature around the third heater 53 (the sensing inductor).

That is, when it is considered that a temperature around the third heater 53 changes according to the amount of air passing through the third heater 53 through the frost detection flow path 710, this temperature change may be measured by the temperature sensor 732 and then based on this temperature change, the degree of frost formed on the second evaporator 22 may be calculated.

According to the embodiment of the present disclosure, the frost check sensor 730 may include the sensor printed circuit board (PCB) 733.

The sensor PCB 733 may be configured to determine the difference between a temperature detected by the temperature sensor 732 when the third heater 53 is turned off and a temperature detected by the temperature sensor 732 when the third heater 53 is turned on.

Of course, the sensor PCB 733 may be configured to determine whether the logic temperature ΔHt is less than or equal to a reference difference value.

For example, when the amount of frost formed on the second evaporator 22 is small, the amount of air flowing through the frost detection flow path 710 may be small, and in this case, heat generated according to the turning on of the third heater 53 may be cooled relatively little by the flowing air.

Accordingly, a temperature sensed by the temperature sensor 732 may increase, and the logic temperature ΔHt may also increase.

On the other hand, when the amount of frost formed on the second evaporator 22 is large, the amount of air flowing through the frost detection flow path 710 may be large, and in this case, heat generated according to the turning on of the third heater 53 may be cooled relatively much by the flowing air.

Accordingly, a temperature detected by the temperature sensor 732 may decrease, and the logic temperature ΔHt may also decrease.

In the end, the amount of frost formed on the second evaporator 22 may be accurately determined according to whether the logic temperature ΔHt is high or low, and based on the amount of frost formed on the second evaporator 22 determined in this manner, the defrosting operation may be performed at accurate time.

That is, when the logic temperature ΔHt is high, it may be determined that the amount of frost formed on the second evaporator 22 is small, but when the logic temperature ΔHt is low, it may be determined that the amount of frost formed on the second evaporator 22 is large.

Accordingly, a reference temperature difference value may be designated and when the logic temperature ΔHt is lower than the designated reference temperature difference value, it may be determined that the defrosting operation of the second evaporator is necessary.

Meanwhile, the frost check sensor 730 may be installed in a direction crossing a direction of air passing through the inside of the frost detection flow path 710, and the surface of the frost check sensor 730 and the inner surface of the frost detection flow path 710 may be located to be spaced apart from each other.

That is, water may flow down through a gap between the frost check sensor 730 and the frost detection flow path 710.

In this case, the gap has preferably a distance such that water does not stagnate between the surface of the frost check sensor 730 and the inner surface of the frost detection flow path 710.

It may be preferable that the third heater 53 and the temperature sensor 732 are together located on any one surface of the frost check sensor 730.

That is, by placing the third heater 53 and the temperature sensor 732 on the same surface, the temperature sensor 732 may more accurately sense a temperature change caused by heat generated by the third heater 53.

In addition, inside the frost detection flow path 710, the frost check sensor 730 may be disposed between the fluid inlet 711 and the fluid outlet 712 of the frost detection flow path 710.

Preferably, the frost check sensor 730 may be disposed at a position spaced apart from the fluid inlet 711 and the fluid outlet 712.

For example, the frost check sensor 730 may be disposed at a center point inside the frost detection flow path 710, at a portion closer to the fluid inlet than to the fluid outlet 712 inside the frost detection flow path 710, or at a portion closer to the fluid outlet than to the fluid inlet inside the frost detection flow path 710.

In addition, the frost check sensor 730 may further include a sensor housing 734. The sensor housing 734 may function to prevent water flowing down on the inside of the frost detection flow path 710 from being in contact with the third heater 53, the temperature sensor 732, or the sensor PCB 733.

The sensor housing 734 may be formed to be open at at least one of opposite ends thereof. Accordingly, it is possible to draw out a power line (or a signal line) from the sensor PCB 733.

Next, the refrigerator 1 according to the embodiment of the present disclosure may include a controller 80. As illustrated in FIG. 9, the controller 80 may be a device that controls the operation of the refrigerator 1. The controller may be a microprocessor, an electrical logic circuit, etc.

The controller 80 may be configured to perform temperature control of each of the storage compartments 12 and 13.

To this end, the controller 80 may control the amount of supplied cold air to be increased such that the internal temperature of the associated storage compartment can decrease when the internal temperature of each of the storage compartments 12 and 13 is in a dissatisfaction temperature range classified on the basis of the set reference temperature NT which a user sets for the associated storage compartment, and may control the amount of supplied cold air to be decreased when the internal temperature of each of the storage compartments 12 and 13 is in a satisfaction temperature range classified on the basis of the set reference temperature NT.

In addition, the controller 80 may be configured such that the frost detection device 70 performs the frost detection operation.

To this end, the controller 80 may be configured to perform the frost detection operation for a set period of frost detection time.

The period of frost detection time may be controlled to change according to a temperature value of the room temperature measured by the first temperature sensor 1*a* or a temperature set by a user.

For example, the period of frost detection time may be controlled to be short due to more frequent cooling operation performed as a room temperature increases, but may be controlled to be sufficiently long due to less frequent cooling operation performed as the room temperature decreases.

In addition, the controller 80 may control the frost check sensor 730 to operate in a predetermined cycle.

That is, due to the control of the controller 80, the third heater 53 of the frost check sensor 730 may generate heat for a predetermined period of time, and the temperature sensor 732 of the frost check sensor 730 may detect a temperature immediately after the third heater 53 is turned on and a temperature immediately after the third heater 53 is turned off.

Through this, a minimum temperature and a maximum temperature may be checked after the third heater 53 is turned on, and a temperature difference value between the minimum temperature and the maximum temperature may be maximized, so discrimination power for frost detection may be further improved.

In addition, the controller 80 may be configured to check the temperature difference value ΔHt (a logic temperature) between the turning on and off of the third heater 53 and determine whether the maximum value of the logic temperature ΔHt is less than or equal to a first reference difference value.

In this case, the first reference difference value may be a value set to a degree that defrosting operation is not required to be performed.

Of course, the checking of the logic temperature ΔHt and the comparison of the logic temperature with the first reference difference value may be performed by the sensor PCB 733 constituting the frost check sensor 730.

In this case, the controller 80 may be configured to receive a result value obtained through the checking of the logic temperature ΔHt and the comparison of the logic temperature ΔHt with the first reference difference value performed by the sensor PCB 733 and to control the turning on/off of the third heater 53.

In addition, the controller 80 may be configured to perform defrosting operation.

That is, when the physical property (the logic temperature) of fluid measured by the frost check sensor 730 of the frost detection device 70 reaches a set value, the controller 80 may be configured to perform defrosting operation for defrosting the cold air source (the second evaporator).

The defrosting operation may be performed in such a manner that the controller 80 controls the turning on/off (output) of at least one heater of the first heater 51, the second heater 52, and the third heater 53.

Particularly, the controller 80 may be configured to control the operation of the third heater 53 such that the inside of the frost detection flow path 710 may be maintained at a temperature of 0° C. or more during the defrosting operation.

That is, the third heater 53 may be controlled to generate heat during defrosting operation such that the inside of the frost detection flow path 710 have a temperature above zero.

The controller 80 may be configured to control the operation of the second heater 52 such that the temperature of the fluid outlet 712 of the frost detection flow path 710 is higher than the temperatures of other portions (the fluid inlet or the center portion) of the frost detection flow path 710 while the controller 80 performs a defrosting operation.

That is, when it is considered that the second heater 52 is located to be adjacent to the fluid outlet 712, the fluid outlet 712 of the frost detection flow path 710 may be maintained at the highest temperature through the control of the operation of the second heater 52 described above.

Accordingly, even if ice in the form of a lump separated from the second evaporator 22 is introduced into the frost detection flow path 710 during the defrosting operation, the associated ice may be melted such that the inside of the frost detection flow path 710 may be prevented from being blocked due to the lump of ice.

In addition, the controller 80 may be configured to determine whether the second evaporator 22 has residual ice at the end of the defrosting operation.

That is, the controller 80 may perform defrosting based on the logic temperature ΔHt, and may determine whether the second evaporator 22 has residual ice when the defrosting is completed.

When it is determined that residual ice remains in the second evaporator 22 despite the completion of the defrosting, the controller 80 may control the defrosting operation to be performed again or the next defrosting operation to be performed earlier than a reference time point.

Next, a process of performing the defrosting operation after detecting the amount of frost formed in the second evaporator 22 of the refrigerator 1 according to the embodiment of the present disclosure will be described.

FIG. 21 is a flowchart of a method of performing defrosting operation by determining time at which defrosting of the refrigerator is required according to the embodiment of the present disclosure, and FIGS. 20 and 22 are views illustrating the change of a temperature measured by the frost check sensor before and after frost is formed on the second evaporator according to the embodiment of the present disclosure.

FIG. 20 illustrates the temperature change of the second storage compartment 13 and the temperature change of the third heater 53 before frost is formed on the second evaporator 22, and FIG. 22 illustrates the temperature change of the second storage compartment 13 and the temperature change of the third heater 53 while frost is formed on the second evaporator 22.

As illustrated in these drawings, after previous defrosting operation is completed at S1, the cooling operation of each of the storage compartments 12 and 13 based on the first set reference temperature and the second set reference temperature may be performed by the control of the controller 80 at S110.

In this case, the cooling operation described above may be performed through the operation control of at least any one of the first evaporator 21 and the first cooling fan 31 according to the first operation reference value designated on the basis of the first set reference temperature, and may be performed through the operation control of at least any one of the second evaporator 22 and the second cooling fan 41 according to the second operation reference value designated on the basis of the second set reference temperature. For example, the controller 80 may control the first cooling fan 31 to operate when the internal temperature of the first storage compartment 12 is in the dissatisfaction temperature range classified on the basis of the first set reference temperature set by a user, and may control the first cooling fan 31 to stop when the internal temperature is in the satisfaction temperature range.

In this case, the controller 80 may selectively open/close each of the refrigerant passages 61 and 62 by controlling the refrigerant valve 63 such that the cooling operation for the first storage compartment 12 and the second storage compartment 13 is performed.

In addition, in the cooling operation for the second storage compartment 13, air (cold air) passing through the second evaporator 22 may be provided to the second storage compartment 13 by the operation of the second cooling fan 41, and the cold air circulating in the second storage compartment 13 may flow to the air inflow side of the second evaporator 22 by being guided by the introduction duct 42*a* constituting the second fan duct assembly 40, and then may repeat the flow of passing through the second evaporator 22 again.

In this case, most (e.g., about 98%) of the air flowing to the air inflow side of the second evaporator 22 under the guidance of the introduction duct 42*a* may pass through the second evaporator 22, but some (e.g., about 2%) of the air may be introduced into the frost detection flow path 710 through the fluid inlet 711 of the frost detection flow path 710 located at the air inflow side of the second evaporator 22.

Particularly, the fluid outlet 712 of the frost detection flow path 710 may be disposed at a position (a position considering a separation distance from the second cooling fan) in consideration of the influence of pressure generated by the operation of the second cooling fan 41 as well as in consideration of pressure difference between the fluid outlet 712 and the fluid inlet 711.

Accordingly, air passing through the frost detection flow path 710 may be less influenced by pressure caused by the second cooling fan 41, and some of the air may be forced to flow due to the pressure difference between the fluid outlet 712 and the fluid inlet 711 despite the absence of frost on the second evaporator, and accordingly, minimum discrimination power (temperature difference between temperatures before and after frost is formed) for detecting frost may be obtained.

In addition, during the normal cooling operation described above, it may be continuously checked whether a cycle for the frost detection operation has been reached at S120.

In this case, the cycle of performing the frost detection operation may be a cycle of time or may be a cycle in which a specific component or the same operation such as an operation cycle is repeatedly performed.

In the embodiment of the present disclosure, the cycle may be a cycle in which the second cooling fan 41 operates.

That is, when it is considered that the frost detection device 70 is configured to check the amount of frost formed on the second evaporator 22 on the basis of the temperature difference value ΔHt (the logic temperature) according to the change of the flow rate of air passing through the frost detection flow path 710, as the logic temperature ΔHt increases, the reliability of a detection result by the frost detection device 70 may be secured, and the largest logic temperature ΔHt may be obtained when the second cooling fan 41 operates.

In this case, the cycle may be every operation time period of the second cooling fan 41, or an alternative operation time period of the second cooling fan 41. Of course, immediately after the defrosting operation is completed, the frost detection operation may not be required to be frequently performed, so for example, the cycle may be set such that the frost detection operation is performed every time the second cooling fan 41 operates three times.

In addition, the second cooling fan 41 of the second fan duct assembly 40 may operate when the first cooling fan 31 of the first fan duct assembly 30 stops. Of course, when required, the second cooling fan 41 may be controlled to operate even when the first cooling fan 31 does not completely stop.

In addition, in order to increase difference between temperature values according to the changes of the flow rate of air passing through the frost detection flow path 710, the flow rate of the air should be high. That is, a change in air flow rate for which reliability cannot be secured may be virtually meaningless or may cause an error in judgment.

In consideration of this, it may be preferable that the frost check sensor 730 is operated during the operation of the second cooling fan 41 in which there is a substantial change in an air flow rate. That is, while the second cooling fan 41 operates, the third heater 53 of the frost check sensor 730 may be preferably controlled to generate heat.

The third heater 53 may be controlled to generate heat at the same time at which power is supplied to the second cooling fan 41, immediately after power is supplied to the second cooling fan 41, or when a predetermined condition is satisfied in a state in which power is supplied to the second cooling fan 41.

In the embodiment of the present disclosure, as an example, the third heater 53 is controlled to generate heat when a predetermined heating condition is satisfied in a state in which power is supplied to the second cooling fan 41.

That is, when a cycle for the frost detection operation has been reached, the heating condition of the third heater 53 may be checked at S130, and then when the heating condition is satisfied, the third heater 53 may be controlled to generate heat.

The heating condition may include at least any one condition of a condition in which the heating element is automatically controlled to generate heat when a predetermined period of time elapses after the operation of the second cooling fan 41, a condition in which the internal temperature of the frost detection flow path 710 (a temperature checked by the temperature sensor) gradually decreases before the operation of the second cooling fan 41, a condition in which the second cooling fan 41 is operating, and a condition in which the door of the second storage compartment 13 is not opened.

In addition, when it is checked that the heating condition as described above is satisfied, the third heater 53 may generate heat at S140 under the control of the controller 80 (or the control of the sensor PCB).

In addition, when heating of the third heater 53 is performed, the temperature sensor 732 may detect the physical property of fluid in the frost detection flow path 710, that is, a temperature Ht1 of the fluid at S150.

The temperature sensor 732 may detect the temperature Ht1 simultaneously with the heating of the third heater 53, or may detect the temperature Ht1 immediately after the heating of the third heater 53 is performed.

Particularly, the temperature Ht1 detected by the temperature sensor 732 may be the lowest temperature of the inside of the frost detection flow path 710 that is checked after the third heater 53 is turned on.

The detected temperature Ht1 may be stored in the controller 80 (or the sensor PCB).

In addition, the heating of the third heater 53 may be performed during the set period of heating time. In this case, the set period of heating time may be enough period of time to discriminate the change of the internal temperature of the frost detection flow path 710.

For example, when the third heater 53 generates heat for the set period of heating time, discrimination power may be obtained except for the logic temperature ΔHt due to other factors predicted or unpredicted.

The set period of heating time may be a specific period of time or may be a period of time that varies according to a surrounding environment.

For example, when the operation cycle of the first cooling fan 31 for the cooling operation of the first storage compartment 12 is changed to be shorter than a previous operation cycle thereof, the set period of heating time may be shorter than difference between a period of time required for the changed cycle and the period of time required for the heating condition described above.

In addition, when a period of operation time of the second cooling fan 41 for the cooling operation of the second storage compartment 13 is changed to be shorter than a period of previous operation time thereof, the set period of heating time may be shorter than difference between a period of the changed time and the period of time required for the heating condition described above.

In addition, the set period of heating time may be shorter than a period of operation time of the second cooling fan 41 when the second storage compartment 13 operates at full load.

In addition, the set period of heating time may be shorter than difference between the period of operation time of the second cooling fan 41 according to the change of the internal temperature of the second storage compartment 13 and the period of time required for the heating condition described above.

In addition, the set period of heating time may be shorter than the difference between a period of operation time of the second cooling fan 41 changing according to the internal temperature of the second storage compartment 13 set by a user and the period of time required for the heating condition described above.

In addition, when the set period of heating time elapses, power supply to the third heater 53 may be cut off and heat generation by the third heater 53 may stop at S160.

Of course, even if the period of heating time does not elapse, power supply to the third heater 53 may be controlled to be stopped.

For example, when a temperature detected by the temperature sensor 732 exceeds a set temperature value (for example, 70° C.), power supply to the third heater 53 may be controlled to be stopped, and when the door of the second storage compartment 13 is opened, power supply to the third heater 53 may be controlled to be stopped.

When an unexpected operation (operation of the first cooling fan) of the first storage compartment 12 occurs, power supply to the third heater 53 may be controlled to be cut off.

When the second cooling fan 41 is turned off, power supply to the third heater 53 may be controlled to be stopped.

When the heating of the third heater 53 stops, the physical property of fluid, that is, a temperature Ht2 of the fluid in the frost detection flow path 710 may be detected by the temperature sensor 732 at S170.

In this case, temperature detection by the temperature sensor 732 may be performed at the same time at which the heating of the third heater 53 stops, or immediately after the heating of the third heater 53 stops.

Particularly, the temperature Ht2 detected by the temperature sensor 732 may be a maximum internal temperature of the frost detection flow path 710 checked before and after the third heater 53 is turned off.

The detected temperature Ht2 may be stored in the controller 80 (or the sensor PCB).

In addition, the controller 80 (or the sensor PCB) may calculate the logic temperature ΔHt between detected temperatures Ht1 and Ht2 on the basis of the detected temperatures Ht1 and Ht2, and on the basis of the calculated logic temperature ΔHt, to determine whether to perform defrosting operation for the cold air source 22 (the second evaporator).

That is, after the difference value ΔHt between the temperature Ht1 during the heating of the third heater 53 and the temperature Ht2 during the end of the heating of the third heater 53 is calculated and stored at S180, whether to perform the defrosting operation may be determined based on the logic temperature ΔHt.

For example, when the logic temperature ΔHt is higher than a set first reference difference value, an air flow rate in the frost detection flow path 710 may be low, and thus it may be determined that the amount of frost formed in the second evaporator 22 is small to a degree that the defrosting operation is not performed.

That is, when the amount of frost formed in the second evaporator 22 is small, pressure difference between the air inflow side and air outflow side of the second evaporator 22 may be low, and the flow rate of air flowing in the frost detection flow path 710 may be low, so the logic temperature ΔHt may be relatively high.

On the other hand, when the logic temperature ΔHt is lower than a set second reference difference value, an air flow rate in the frost detection flow path 710 may be high, and thus it may be determined that the amount of frost formed in the second evaporator 22 requires the performance of defrosting operation.

That is, when the amount of frost formed in the second evaporator 22 is large, pressure difference between the air inflow side and air outflow side of the second evaporator 22 may be high, and due to this pressure difference, the flow rate of air flowing in the frost detection flow path 710 may be high, so the logic temperature ΔHt may be relatively low.

In this case, the second reference difference value may be a value set to such an extent that the defrosting operation is required to be performed. Of course, the first reference difference value and the second reference difference value may be the same value, and the second reference difference value may be set as a value smaller than the first reference difference value.

Each of the first reference difference value and the second reference difference value may be one specific value or a value of a range.

For example, the second reference difference value may be 24° C., and the first reference difference value may be a temperature between 24° C. and 30° C.

In addition, as a result of the determination described above, when the logic temperature ΔHt checked by the controller 80 is higher than the set first reference difference value, it may be determined that the amount of frost formed in the second evaporator 22 is less than the set amount of frost for performance of defrosting operation.

In this case, after the second cooling fan 41 stops, frost detection may stop until the second cooling fan 41 operates in a next cycle.

Next, when the operation of the second cooling fan 41 of the next cycle is performed, the process of determining whether the heating condition for the frost detection described above is satisfied may be repeatedly performed.

On the other hand, when the logic temperature ΔHt checked by the controller 80 is lower than the set second reference difference value, it may be determined that the second evaporator 22 has frost more than the set amount of frost, and thus defrosting operation may be controlled to be performed at S2.

In this case, during the defrosting operation, a stored logic temperature ΔHt for each frost detection cycle may be reset.

Next, the process S2 of performing the defrosting operation for the second evaporator 22 of the refrigerator according to the embodiment of the present disclosure will be described.

First, after the third heater 53 is turned off, the defrosting operation may be performed according to the determination of the controller 80.

During the defrosting operation, the first heater 51 constituting the defrosting device 50 may generate heat.

That is, heat generated by the first heater 51 may remove frost formed in the second evaporator 22.

In this case, when it is considered that the first heater 51 is configured as the sheath heater, heat generated by the first heater 51 may remove frost formed on the second evaporator 22 through radiation and convection.

Heat generated by the first heater 51 may be provided even to the fluid inlet 711 of the frost detection flow path 710 adjacent to the first heater 51. Accordingly, the temperature of the fluid inlet 711 may be a temperature above zero (or 0° C. or more). This is illustrated in FIG. 16.

Particularly, the heat generation of the first heater 51 may be controlled so that the fluid inlet 711 of the frost detection flow path 710 is maintained at a temperature above zero. That is, the output of the first heater 51 may be varied in consideration of the internal temperature of the frost detection flow path 710.

In addition, during the defrosting operation, the second heater 52 constituting the defrosting device 50 may generate heat.

That is, heat generated by the second heater 52 may remove frost formed in the second evaporator 22.

In this case, when considering that the second heater 52 is configured as the L-cord heater, heat generated by the second heater 52 may be conducted to the heat exchange fins of the second evaporator 22 and remove frost that has formed on the second evaporator 22.

Heat generated by the second heater 52 may be provided even to the fluid outlet 712 of the frost detection flow path 710 adjacent to the second heater 52. Accordingly, a temperature of the fluid outlet 712 may be a temperature above zero (or 0° C. or more). This is illustrated in FIG. 16.

Particularly, the heat generation of the second heater 52 may be controlled such that the fluid outlet 712 of the frost detection flow path 710 is maintained at a temperature above zero. That is, the output of the second heater 52 may be varied in consideration of the internal temperature of the frost detection flow path 710.

In addition, during the defrosting operation, the third heater 53 constituting the defrosting device 50 may generate heat.

That is, the frost check sensor 730 located inside the frost detection flow path 710 may be maintained at a temperature above zero by heat generated by the third heater 53. This is illustrated in FIG. 16.

Of course, the fluid inlet 711 and fluid outlet 712 of the frost detection flow path 710 may be maintained at a temperature above zero by heat generated by the first heater 51 and the second heater 52.

However, in the inner space of the frost detection flow path 710, such as a center portion between the fluid inlet 711 and the fluid outlet 712, it may be difficult to completely receive heat of the first heater 51 and the second heater 52 provided to the fluid inlet 711 and the fluid outlet 712, and thus may have a temperature which drops to a temperature of 0° C. or less.

In consideration of this, due to the additional provision of the third heater 53 and the heating of the third heater 53 during defrosting operation, the center portion of the inside of the frost detection flow path 710 may also be maintained at a temperature above 0° C. This is illustrated in FIG. 16.

Particularly, the third heater 53 may be located to be closer to the fluid outlet 712 than to the fluid inlet 711 among each portion inside the frost detection flow path 710, and a portion (or a portion at which the frost check sensor is located) at which the third heater 53 is located may be maintained at a temperature higher than the temperature of the center portion between the frost check sensor 730 and the fluid outlet 712.

Accordingly, in a state in which defrost water or a lump of ice introduced from the fluid outlet 712 is sufficiently melted without freezing while passing through the frost detection flow path 710, the defrost water or the melted lump of ice may pass through each portion of the frost detection flow path 710 to flow out of the frost detection flow path.

Meanwhile, the first heater 51 and the second heater 52 may be controlled to simultaneously generate heat, or after the first heater 51 first generates heat, the second heater 52 may be controlled to generate heat, or after the second heater 52 first generates heat, the first heater 51 may be controlled to generate heat.

The third heater 53 may be controlled to generate heat simultaneously with the first heater 51 and the second heater 52, or before the first heater 51 and the second heater 52 generate heat, or immediately after the first heater 51 and the second heater 52 generate heat.

In addition, after heating of each of the heaters 51, 52, and 53 is performed for a set period of time, the heating of each of the heaters 51, 52, and 53 may stop.

In this case, each of the heaters 51, 52, and 53 may be controlled to simultaneously stop heating, or heating may be controlled to be stopped sequentially starting from any one heater of the heaters.

A period of time set for heating of each of the heaters 51 and 52 may be set as a specific period of time (e.g., one hour), and may be set as a period of time changing according to the amount of formed frost.

In addition, each of the heaters 51, 52, and 53 may be operated with a maximum load during operation thereof. The fluid outlet 712 of the frost detection flow path 710 may have a larger opening area than the fluid inlet 711 and may be influenced simultaneously by the second heater 52 and the third heater 53, so the fluid outlet 712 may have a higher temperature range than the fluid inlet 711.

Particularly, the heat generation (on/off) of each of the heaters 51, 52, and 53 may be controlled by the controller such that the internal temperature of the frost detection flow path 710 may have a temperature above zero.

Of course, each of the heaters 51, 52, and 53 may operate with a load changing according to the amount of defrosting, and may be controlled with different output according to each situation.

In addition, the defrosting operation may be performed based on time or temperature.

That is, the defrosting operation may be controlled to end when the defrosting operation is performed for a certain period of time, and when the temperature of the second evaporator 22 reaches a set temperature.

In addition, when the operation of the defrosting device 50 described above is completed, the first cooling fan 31 may operate with a maximum load such that the first storage compartment 12 reaches a set temperature range, and then the second cooling fan 41 may operate with a maximum load such that the second storage compartment 13 reaches a set temperature range.

In this case, during the operation of the first cooling fan 31, a refrigerant compressed by the compressor 60 may be controlled to be provided to the first evaporator 21, and during the operation of the second cooling fan 41, a refrigerant compressed by the compressor 60 may be controlled to be provided to the second evaporator 22.

In addition, when a temperature condition of each of the first storage compartment 12 and the second storage compartment 13 is satisfied, the above-described control for detecting the formation of frost on the second evaporator 22 performed by the frost detection device 70 may be sequentially performed again.

Of course, it may be more preferable that by detecting residual ice immediately after the operation of the defrosting device 50 is completed, whether to perform additional defrosting operation is determined.

That is, when residual ice is checked, additional defrosting operation may be performed even if time for the defrosting operation has not been reached, and thus the residual ice may be completely removed.

In the end, in the refrigerator 1 of the present disclosure, the third heater 53 may be provided in the frost detection flow path 710, and thus when defrosting the cold air source (the second evaporator), the freezing of the inside of the frost detection flow path 710 may also be prevented.

Particularly, although in the frost detection flow path 710, a portion at which the frost check sensor 730 is located has a narrower flow path than other portions, it is possible to prevent the freezing of defrost water during a pooling of the defrost water on the portion at which the frost check sensor 730 is located while the defrost water is flowing down.

In addition, in the refrigerator of the present disclosure, the first heater 51 and the second heater 52 may be disposed such that sufficient heat may be supplied to the fluid inlet 711 and the fluid outlet 712 of the frost detection flow path 710, or the fluid inlet 711 and the fluid outlet 712 may be disposed according to the disposition of the first heater 51 and the second heater 52, so that the portions at the fluid inlet 711 and the fluid outlet 712 of the frost detection flow path 710 may have a temperature above 0° C. during the heating of the first heater 51 and the second heater 52.

In addition, in the refrigerator of the present disclosure, the third heater 53 may be provided in the frost check sensor 730 and may be configured to detect frost and to maintain the inside of the frost detection flow path 710 at a temperature above zero during defrosting operation, so components may be minimized, and thus the flow path of the inside of the frost detection flow path 710 may be prevented from being blocked.

In addition, in the refrigerator of the present disclosure, the fluid outlet 712 of the frost detection flow path 710 may be configured to maintain a temperature higher than the temperature of the fluid inlet 711, and thus even if a block of ice or defrost water including thin ice from the cold air source (the second evaporator) is introduced through the fluid outlet 712 into the frost detection flow path 710, the associated ice may be sufficiently melted, so the flow path of the inside of the frost detection flow path 710 may be prevented from being blocked.

The invention claimed is:

1. A refrigerator comprising:

a casing which provides a storage compartment;

a cold air source which generates cold air supplied to the storage compartment;

a first duct which guides the cold air inside the storage compartment to move to the cold air source;

a second duct which guides the cold air around the cold air source to move to the storage compartment;

a frost detection device which detects an amount of frost or ice formed on the cold air source;

a defrosting device which defrosts at least any one of the cold air source and the frost detection device; and a controller which controls the defrosting device, wherein the frost detection device comprises a frost detection flow path which provides a flow path in which a portion of the cold air moves in the flow path; and a frost check sensor which is disposed in the frost detection flow path to measure a physical property of the portion of the cold air passing in the flow path, a fluid inlet through which the portion of the cold air is introduced into the frost detection flow path, and a fluid outlet through which the portion of the cold air flows out of the frost detection flow path; and the defrosting device comprises a first heater disposed at the fluid inlet of the frost detection flow path, a second heater disposed at the fluid outlet of the frost detection flow path, and a third heater disposed between the first heater and the second heater, and the first heater is a heater having a higher output than the second heater, and the third heater is a heater having a lower output than the first heater or the second heater.

2. The refrigerator of claim 1, wherein a portion of the frost detection flow path is disposed in a flow path formed between the first duct and the cold air source.

3. The refrigerator of claim 1, wherein a portion of the frost detection flow path is disposed in a flow path formed between the second duct and the storage compartment.

4. The refrigerator of claim 1, wherein the physical property comprises at least one of a temperature, pressure, and a flow rate.

5. The refrigerator of claim 1, wherein the frost check sensor comprises a sensor and a sensing inductor.

6. The refrigerator of claim 5, wherein the sensing inductor comprises a heating element which generates heat.

7. The refrigerator of claim 1, wherein the frost check sensor comprises a sensor and uses the third heater located inside the frost detection flow path as a sensing inductor.

8. The refrigerator of claim 1, wherein the cold air source comprises at least one of a thermoelectric module or an evaporator.

9. The refrigerator of claim 8, wherein when the cold air source is the evaporator, the refrigerator comprises a refrigerant valve which controls an amount of a refrigerant supplied to the evaporator.

10. The refrigerator of claim 1, wherein an opening area provided by the fluid outlet of the frost detection flow path is larger than an opening area provided by the fluid inlet of the frost detection flow path.

11. The refrigerator of claim 1, wherein when the physical property measured by the frost detection device reaches a set value, the controller is configured to perform defrosting operation to defrost the cold air source.

12. The refrigerator of claim 11, wherein the controller is configured to control at least one of the first heater, the second heater, or the third heater to operate during the defrosting operation.

13. The refrigerator of claim 12, wherein the controller is configured to control operation of the third heater to maintain an inside of the frost detection flow path at a temperature of 0° C. or more during the defrosting operation.

14. The refrigerator of claim 13, wherein a part having a lowest temperature of temperatures inside the frost detection flow path is more closer to the first heater than to the second heater.

15. The refrigerator of claim 12, wherein the controller is configured to operate the second heater such that a temperature of the fluid outlet is highest among temperatures at the frost detection flow path during the defrosting operation.

16. The refrigerator of claim 1, wherein the frost check sensor is located at the frost detection flow path closer to the fluid outlet than to the fluid inlet.

17. The refrigerator of claim 16, wherein the third heater is provided in the frost check sensor.

18. The refrigerator of claim 16, wherein the controller is configured to maintain a temperature at a part in which the frost check sensor is located inside the frost detection flow path higher than a temperature of a center portion between the frost check sensor and the fluid outlet when defrosting operation for defrosting the cold air source is performed.

19. The refrigerator of claim 18, wherein the third heater generates heat when the defrosting operation for defrosting the cold air source is performed.

20. The refrigerator of claim 16, wherein inside the frost detection flow path, the third heater maintains a temperature at a part at which the third heater is located higher than a temperature of a center portion between the frost check sensor and the fluid outlet when the defrosting operation for defrosting the cold air source is performed.

* * * * *